United States Patent [19]

Tooka et al.

[11] 4,023,338

[45] May 17, 1977

[54] METHOD AND APPARATUS FOR DOFFING FULL PACKAGED BOBBINS IN A FLY FRAME

[75] Inventors: Takuzo Tooka; Hidejiro Araki, both of Toyoake; Mitsuo Mori, Toyota; Katumi Nakane, Okazaki; Toshio Morishita, Kariya, all of Japan

[73] Assignee: Kabushiki Kaisha Toyoda Jidoshokki Seisakusho, Aichi, Japan

[22] Filed: Sept. 29, 1975

[21] Appl. No.: 617,813

[30] Foreign Application Priority Data

Oct. 3, 1974 Japan ..... 49-114196

[52] U.S. Cl. ..... 57/52; 57/102; 57/156

[51] Int. Cl.[2] ..... D01H 9/08

[58] Field of Search ..... 597/34 R, 52, 53, 54, 597/102, 156

[56] References Cited

UNITED STATES PATENTS

| | | | |
|---|---|---|---|
| 2,819,580 | 1/1958 | Teupel | 57/52 |
| 3,380,238 | 4/1968 | Araki et al. | 57/52 |
| 3,398,519 | 8/1968 | Haussmann | 57/52 |
| 3,681,905 | 8/1972 | Furtmeier et al. | 57/52 X |
| 3,791,125 | 2/1974 | Kawakami | 57/52 |
| 3,935,699 | 2/1976 | Iida et al. | 57/52 |
| 3,935,821 | 2/1976 | Maier et al. | 57/52 X |

*Primary Examiner*—John Petrakes

*Attorney, Agent, or Firm*—Burgess Ryan and Wayne

[57] ABSTRACT

This invention is applicable for carrying out the doffing operation of several types of fly frames such as a fly frame provided with an upper rail having a plurality of flyers in suspended condition and a mechanism for driving these flyers therein, and a fly frame provided with a spindle rail and a bobbin rail disposed at a position above the spindle rail in such a condition that the bobbin rail can be displaced vertically during the building motion. According to the doffing method of the present invention, when it is required to carry out the doffing operation, the bobbins containing a full yarn package are relatively displaced to a position free from the corresponding flyers and the engagement of the bobbins with the corresponding bobbin driving mechanisms is released. Next the bobbins containing a full yarn package are carried toward a longitudinal end of the fly frame in a space above the arrangement of the bobbin driving mechanisms. In the preferable embodiment of the present invention, the carrying passage of the bobbin coincides with an alignment of the axial centers of the flyers arranged in the longitudinal direction of the fly frame. A chain conveyer is preferably used for carrying the bobbins. When the bobbin are carried to a longitudinal end of the fly frame, they are discharged from the fly frame. A fresh bobbin supplying device for supplying bobbins to the chain conveyer can be satisfactorily used.

19 Claims, 26 Drawing Figures

CAM PROFILE OF THE CAM MEMBER 156

METHOD AND APPARATUS FOR DOFFING FULL PACKAGED BOBBINS IN A FLY FRAME

SUMMARY OF THE INVENTION

The present invention relates to a method and an apparatus for doffing full packaged bobbins in a fly frame.

Recently, many attempts have been made to adopt large package bobbins and high speed rotation of the fly frame in order to contribute to the rationalization of the spinning industry. Consequently, a rational doffing operation has become a very important problem, the solution to which is essential to the success of the adoption of the large package bobbin and the high speed rotation of the fly frame. That is, since the weight and size of the bobbin become very large, it is impossible to avoid heavy manual labor and the spending of a much longer time for carrying out the doffing operation manually in comparison with the case of utilization of the traditional size bobbin. Due to the recent tendency of labor costs to increase, the above-mentioned problems have become more and more noteworthy.

Several attempts have been made to develop an automatic doffing apparatus to solve the above-mentioned problems. The apparatus disclosed in the respective Japanese pat. publications such as, No. 12057/1966, 12058/1966, 3099/1973 and 1228/1953 may be understood as doffing apparatus which were looked upon to solve the above-mentioned problems. However, these doffing apparatus occupy a space along an entire length of the fly frame, at the front position thereof, and the working elements, such as the doffing levers of the apparatus and carrier, move in this space for the doffing of full packaged bobbins from the fly frame. Further, the construction and driving mechanism of these doffing apparatus are very complex and, consequently, the cost for adopting such apparatus increases the investment in equipment. An additional drawback is that very delicate and careful adjustment of the doffing apparatus is required because suitable timing of the working elements of the apparatus in relation to the motion of the fly frame is essential.

According to our experience, it was found that, in the above-mentioned doffing apparatus, the full packaged bobbins are first displaced upward along their axial direction so as to be free from the respective driving mechanism; thereafter, the full packaged bobbins are displaced to the free space in front of each twisting and winding unit of the fly frame, and; then, these doffed full packaged bobbins are transported to a predetermined position for reserving them. Consequently, it was impossible to improve the operational efficiency of the fly frame.

It was further confirmed that, in the above-mentioned doffing apparatus, a doffing lever means is utilized for displacing the full packaged bobbins and, consequently, that it is essential that the construction of the doffing lever means be sufficiently strong to bear the weight of the respective full packaged bobbin, if the large package system is applied. In addition, it was confirmed that a larger driving power is required for such apparatus in comparison with that necesary when the traditional size of bobbin is utilized. Such additional power requirement aggravates the difficulty of the adoption of the above-mentioned doffing apparatus for the fly frame to which the large package system is adopted.

The principal object of the present invention is to eliminate the above-mentioned problems in the adoption of the known doffing apparatus for the fly frame, by applying a unique method and apparatus for carrying out the doffing operation according to the present invention.

To attain the purpose of the present invention, in the doffing apparatus according to the present invention, it is essential to utilize a particular mechanism for conveying full packaged bobbins, which have been freed from the corresponding flyers and bobbin driving means, toward an outside of the fly frame along the longitudinal direction thereof in a space right above the arrangement of the bobbin driving means. This doffing apparatus can be satisfactorily applied for such fly frames as the fly frame provided with an upper rail, wherein means for supporting and driving the flyers is disposed and the fly frame provided with a spindle rail disposed below a bobbin rail, wherein the flyers of said fly frame are detachably mounted on the corresponding spindles. The above-mentioned fly frames are herein referred to as the fly frame of the first type, the fly frame of the second type, respectively.

In the doffing method according to the present invention, applied to the fly frame of the first type, each flyer is firstly positioned at a standby position axially above the corresponding full packaged bobbin which is positioned above the bobbin driving mechanism in free condition. There are two ways to carry out the above-mentioned first step. That is, either the flyer rail is displaced upward so as to separate the flyers from the respective full packaged bobbins and, then, the bobbins are axially displaced upward so as to disengage the full packaged bobbins from the corresponding bobbin driving mechanism, or the full packaged bobbins are axially displaced downward from the position for carrying out the twisting and winding operation of each machine unit and finally the engagement of each full packaged bobbin with the corresponding bobbin driving mechanism is released.

In the case of applying the present invention to the fly frame of the second type, after each flyer is taken from the corresponding spindles manually or mechanically, the engagement of the full packaged bobbins with the respective bobbin drive mechanism is released by relatively axially displacing the full packaged bobbins to the respective bobbin drive mechanism.

As to the next step to carry out the doffing method according to the present invention, the above-mentioned full packaged bobbins are carried to an outside direction of the fly frame along the longitudinal direction of the fly frame in a space right above the arrangement of a plurality of the bobbin drive mechanisms.

By adopting the above-mentioned doffing method and apparatus according to the present invention, the donning operation can be effectively carried out. That is, after completion of the above-mentioned doffing operation, fresh bobbins are supplied to the respected positions right above the corresponding bobbin drive mechanism with or without utilizing the conveyer mechanism. Thereafter, the fresh bobbins are engaged to the respective bobbin drive mechanism and also positioned at the position for carrying out the twisting and winding operation by axial relative displacement between each fresh bobbin and the corresponding flyer.

A fresh bobbin supply device can be satisfactorily utilized for the present doffing apparatus in connection with the conveyor mechanism.

It is the one of the characteristic effects of the present invention that the space in front of the fly frame is free, because no additional devices are required for carrying out the method of the doffing and donning operation according to the present invention. This is one of the most benefitial results obtained from the adoption of the doffing and donning apparatus of the present invention in comparison with the above-mentioned known doffing apparatus, wherein the above-mentioned front space is occupied by the apparatus. Therefore, the space for installation of the fly frames can be remarkably reduced in comparison with the case of adopting the known doffing and donning apparatus.

A secondary advantage introduced by the doffing apparatus of the present invention is that manual operations such as piecing a broken roving during the spinning operation, can be carried out without disturbance by the doffing and donning apparatus.

Since the doffed full packaged bobbins are carried to the outside of the fly frame by the conveyer means, and the fresh bobbin can be automatically supplied from the fresh bobbin supply device onto the conveyor means and, further, such fresh bobbins are carried to positions right above the corresponding bobbin drive mechanism, the handling of the full packaged bobbins and the fresh bobbins can be effectively carried out, according to the present invention. As mentioned above, a very practical method and apparatus for doffing full packaged bobbins and for donning fresh bobbins in the fly frame are introduced into the spinning industry by the present invention.

DETAILED EXPLANATION OF THE INVENTION BOBBIN DRIVING MECHANISM

Figure 1:
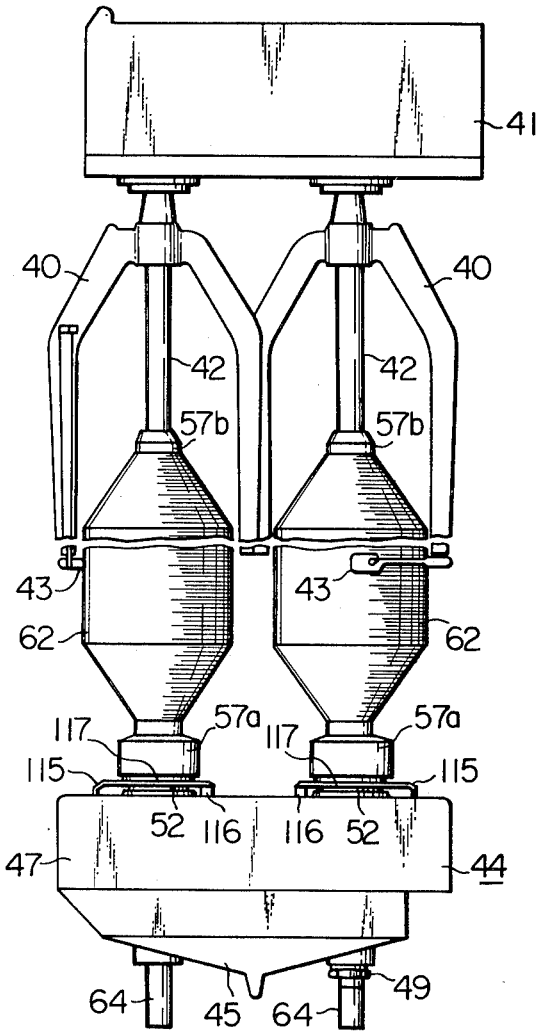
FIG. 1 is a schematic side view, partly omitted, of a twisting and winding unit of the fly frame provided with a doffing apparatus according to the present invention.
Figure 1:
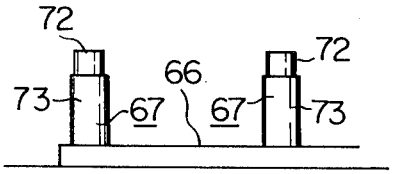

For the sake of a better understanding the present invention, the most preferable embodiment applied to the fly frame of the first type is firstly explained in detail.

Referring to FIG. 1 through FIG. 4, in the fly frame provided with an upper rail 41, a plurality of flyers 40 are disposed in a zig-zag arrangement in two rows which are parallel to each other. They are concurrently rotationally driven by means of a driving mechanism (not shown) mounted in the upper rail. Each flyer 40 has a spindle 42, which extends downwardly from the center of the flyer 40 to the level of lower ends of its legs. At the lower end of one of the legs, there is provided a presser 43, which extends horizontally.

Figure 3:
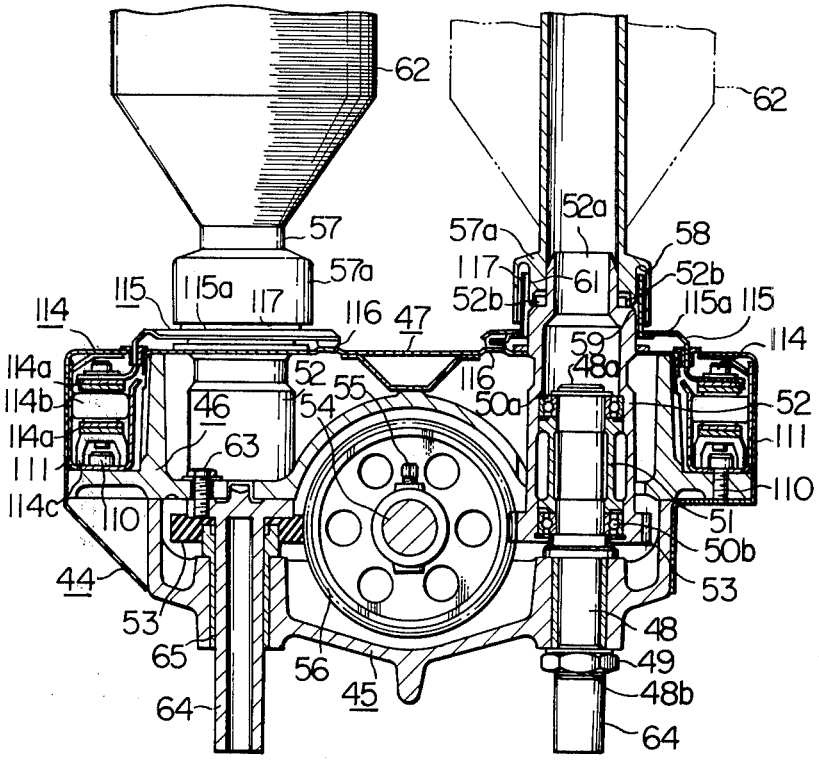
FIG. 3 is a sectional side view of the bobbin drive mechanism of the twisting and winding unit shown in FIG. 1.

A lower frame body 44, which is arranged vertically movably below the upper rail 41 comprises, as best seen from FIGS. 3 and 4, a generally box-shaped bobbin rail 45 with FIGS. 3 and 4, a generally box-shaped bobbin rail 45 with the upper surface open, a conveyor rail 46 vertically separably placed on the upper surface of the bobbin rail 45, and a genrally box-shaped conveyor cover 47 with the lower surface open which is securely mounted so as to cover the upper portion of the conveyor rail 46. When the twisting and winding operation is carried out, these parts 45, 46 and 47 are integrally driven vertically within a predetermined range of traverse by means of a driving mechanism (not shown).

A plurality of supporting shafts 48, each having a supporting portion 48*a* at the upper half thereof and a threaded part 48*b* at the lower end portion thereof, are disposed in a zig-zag arrangement in two rows, which are parallel each other, and are securely mounted with the lower halves penetrating the bottom portion of the bobbin rail 45. The threaded part 48*b* of each shaft 48 is fixed by means of a nut 49. Obviously, the axis of each shaft 48 should coincide with the axis of the corresponding flyer 40. Each supporting shaft 48 rotatably supports, around its supporting portion 48*a*, a pair of bearings 50*a* and 50*b* as well as a hollow bobbin driving shaft 52 for driving each bobbin via a sleeve 51. The hollow bobbin driving shaft 52 extends upwardly through corresponding apertures formed in the conveyor rail 46 and conveyer cover 47, respectively, and is provided with an engagably supporting cylindrical portion 52*a*. The cylindrical portion 52*a* has a diameter smaller than the body of the hollow shaft 52 and also a tapered upper end. The hollow shaft 52 is also provided with a pair of engaging pieces 52*b* at a step formed at the upper end of the shaft 52.

The hollow shaft 52 is further provided with a driven gear 53 formed at the lower end portion thereof.

On the bobbin rail 45, there is rotatably mounted a main driving shaft 54 extending longitudinally between the two rows of the hollow shafts 52 for driving individual bobbins. The main driving shaft 54 is provided with a plurality of driving gears 56 secured thereon by bolts 55 in such a condition that each driving gear 56 always meshes with the driven gear 53 of the corresponding hollow shaft 52. When the twisting and winding operation is carried out, the rotation of the main driving shaft 54, driven by a suitable driving source such as an electrical motor (not shown), is first transmitted to the driving gears 56 and, then, to the individual hollow shafts 52 via the respective driven gears 53, whereby all the hollow shafts 52 for driving bobbins are caused to rotate at once.

Each bobbin 57, which is supportedly engaged with the engagably supporting cylindrical portion 52*a* of each hollow shaft 52, is substantially cylindrical and has a thick portion 57*a* at a part of its bottom. This portion 57*a* has a thicker wall and a larger outer diameter than the bulk of the bobbin. At the bottom of the thick portion 57*a* there is provided an annular groove 58 around the periphery of said portion. A flange, which constitutes the outer wall of the annular groove 58, downwardly protrudes beyond the bottom stepped end 59 of the bobbin. Along the periphery of the bottom stepped end 59 there are formed plural pairs of small cut-out spaces 61, each pair of spaces 61 being capable of engaging with the pair of engaging pieces 52*b* on the bobbin-driving shaft 52. To facilitate the engagement and disengagement of the engaging pieces 52*b* and the cut-out spaces 61, it is convenient to provide a sloped guide edge near each cut-out space so that the engaging piece may slide on this sloped guide edge upon engagement and disengagement. During the twisting and winding operation, the bobbin 57 is securely held upright by the spindle 42 of the corresponding flyer 40 penetrating through a cylindrical guide portion 57*b* into the bobbin 57 as is best seen from FIG. 1.

Thus, during the twisting and winding operation, the lower frame body 44 comprising the bobbin rail 45, the conveyor rail 46 and the conveyor cover 47, is in a position as shown in FIG. 1, where it is caused to integrally move up and down within a predetermined range of traverse; the rotation of the main shaft 54 causes the driving gears 56, the driven gears 53 and, in turn, the individual shafts 52 to rotate, whereby the bobbins 57 supportedly engaged with the respective engagably supporting cylindrical portions 52*b* of the shafts 52 are caused to rotate, and; the flyers 40 are caused to rotate by means of a driving mechanism disposed in the upper rail 40 through its leg and presser 43 to the periphery of each bobbin 57, is twisted and wound up on the periphery of said bobbin 57.

The twisting and winding operation is continued until full yarn packages 62 are formed on the respective bobbins 57. When the full yarn packages 62 are formed on the respective bobbins 57, the main driving shaft 54 is stopped and, then, the lower frame body 44 is caused to integrally descend outside the range of traverse so that the spindles 42 of the flyers 46 are removed from the cylindrical guides 57*b* which constitute the upper portions of the individual bobbins 57, respectively, as shown in FIG. 2.

For the purpose of guiding the bobbin rail 45 which is permitted to separate from an assembly of the conveyor rail 46 and the conveyor cover 47 and to further descend, a plurality of generally cylindrical guide bars 64 are fixed on the lower surface of the conveyor rail 46 at adequate intervals. As seen from FIGS. 3 and 4, each individual guide bar 64 vertically and slidably passes through a separate sleeve 65 rigidly mounted in the bobbin rail 45, and downwardly protrude below the bobbin rail 45. Corresponding to these guide bars 64, a plurality of stoppers 67 are provided on the upper surface of a bottom frame body 66, in such a way that each of said protruding stoppers 67 may come in abutting engagement with the lower end of each guide bar 64, as seen from FIGS. 2 and 4. Each stopper 67, shown in details in FIG. 4, comprises a supporting block 69 fixed on the upper surface of the bottom frame body 66 and having a threaded aperture 68 in the center, a stopper piece 72 having a threaded portion 70 being engagable with the threaded aperture 68 capable of being adjustably fixed at a desired level by means of a nut 71, and a protecting cylinder 73 covering the supporting block 69 and a portion of the stopper piece 72. The level of the stopper piece 72 may be arbitrarily adjusted by rotating the stopper piece 72 thereby changing the length of its threaded portion 70 that is threaded onto the threaded aperture 68.

Figure 2:
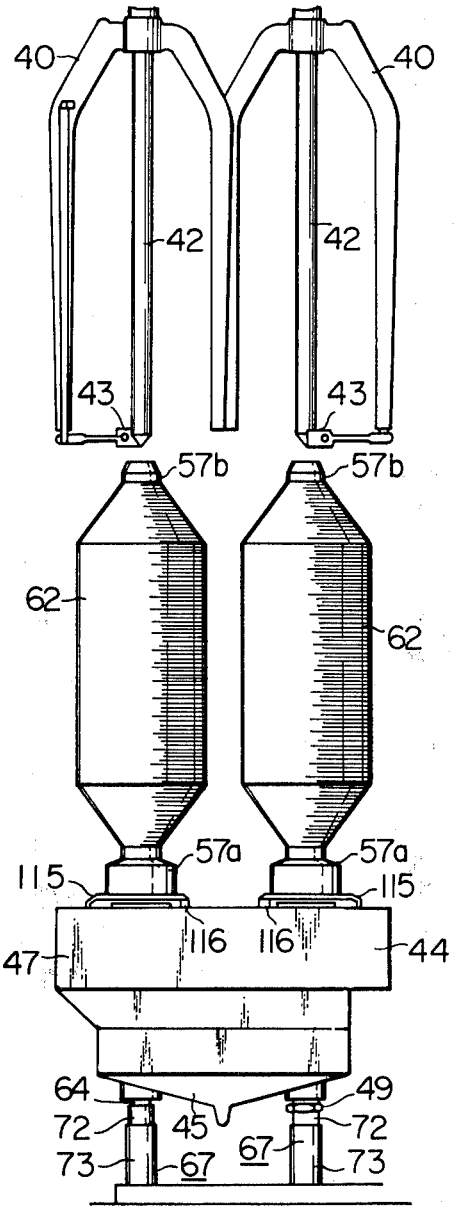
FIG. 2 is a schematic side view, partly omitted, of the twisting and winding unit shown in FIG. 1, in the condition of the first step of the doffing operation.
Figure 4:
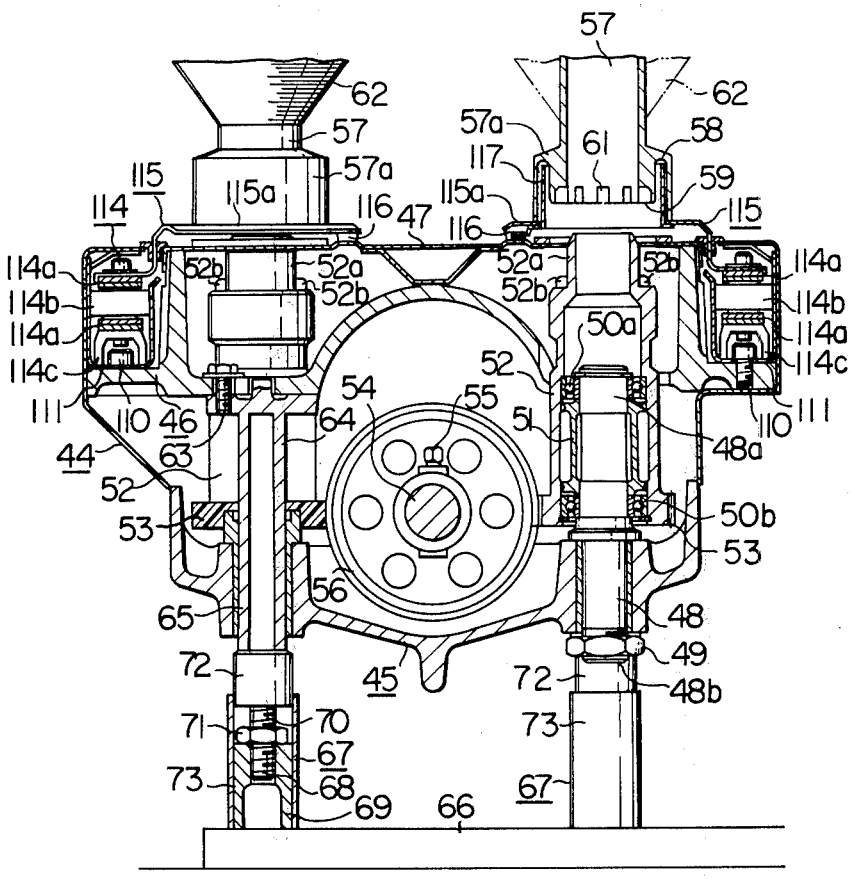
FIG. 4 is a sectional side view of the bobbin drive mechanism of the twisting and winding unit shown in FIG. 2.

Thus, the lower frame body 44 is caused to descend from the raised position for winding as shown in FIG. 1, beyond the range of traverse for winding, to the position shown in FIGS. 2 and 4 where the lower end of each guide bar 64 abutts the upper face of each stopper 67. Then the descending motion of the conveyor rail 46 is restricted by the stoppers 67. Thereafter, the conveyor rail 46 and the conveyor cover 47 are held at positions shown in FIG. 4, while the bobbin rail 45, separating from the conveyer rail 46 and the conveyer cover 47, continues to descend. As the bobbin rail 45 descends, all the shafts 52 supporting the bobbin 57 of the full yarn packages 62 are caused to descend. When the upper end of each shaft 52 comes near the aperture formed in the conveyor cover 47, as is shown in FIG. 4, the descending motion of the bobbin rail 45 is stopped by means of a detecting means, such as a limit switch (not shown). At this moment, all the bobbins 57 of the full yarn packages 62 have been completely disengaged from the respective engagable supporting cylindrical portions 52*a* of the shafts 52 and are ready for being subjected to a conveying means provided on the upper surface of the conveyor rail 46.

BOBBIN CONVEYING MEANS

Figure 5A:
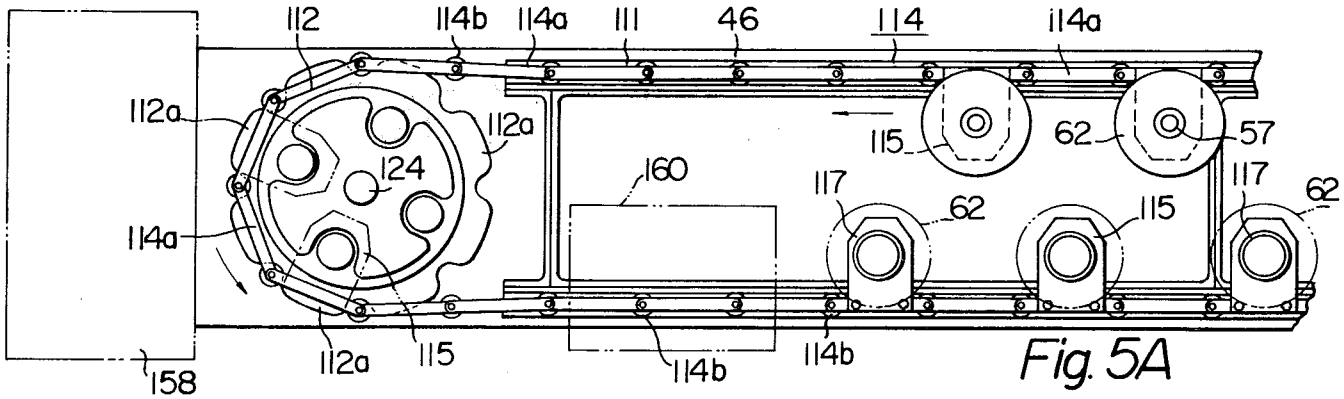
FIGS. 5A and 5B are schematic plan views of the conveying mechanism applied to the embodiment shown in FIG. 1.
Figure 5B:
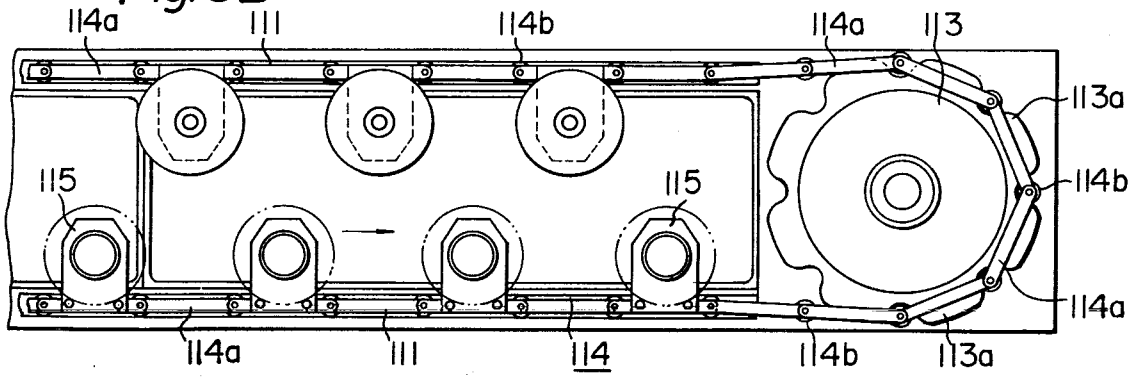

The construction and mechanism of such conveying means will now be described with reference to FIGS. 3, 4, 5A and 5B. A pair of conveyor guide rails 111, each having a generally U-shaped cross-section with the upper face open, are securely fixed by bolts 110 on both sides of the conveyor rail 46. As shown in FIGS. 5A and 5B, the guide rails 111 longitudinally extend in parallel over substantially the whole length of the conveyor rail 46.

A driving sprocket 112 having a plurality of claws 112*a* on the periphery is rotatably mounted on the left end of the conveyor rail 46, while a driven sprocket 113 having a plurality of claws 113*a* on the periphery is rotatably mounted on the right end of the conveyor rail 46. An endless chain conveyor 114 supported by these sprockets 112 and 113 is slidably received in the pair of conveyor guide rails 111 and can be driven by the rotation of the driving sprocket 112 so that it may travel in an orbit, as shown in FIGS. 5A and 5B, in a direction designated by arrows in these FIGURES. The chain conveyor 114 comprises a plurality of chain-piece assemblies 114*a* connected successively by means of rollers 114*b*.

Each chain-piece assembly 114*a* comprises two pieces vertically spaced, and the roller 114*b* is disposed between the above-mentioned two pieces and a leg piece 114*c*. These elements are assembled by a vertical shaft piece as shown in FIGS. 3 and 4, in such a condition that the roller 114*b* is capable of rotating about the vertical shaft piece. The leg 114*c* is capable of sliding on the inside bottom surface of the guide rail 111. The diameter of the roller 114*b* is designed so as to roll on the inner side walls of the guide rail 111. The length of each chain-piece assemblies 114*a* and the space between pieces of each assembly 114*a* designed so that the claws 112*a* and 113*a* of the sprockets 112 and 113, respectively, may successively engage with respective spaces between pairs of chain pieces 114*a*.

A plurality of bobbin holders 115 are mounted on chain piece assembly 114*a* in such a condition that the intervening distance between two adjacent chain pieces holding the bobbin holder 115 coincides with the axial distance between two adjacent bobbin driving shafts 52 arranged along the identical row of flyers. Each bobbin holder 115 comprises an upwardly extended portion which passes through a longitudinal groove formed on the conveyor cover 47 along the row of flyers, a portion extended horizontally above the inside portion of the conveyor cover 47, and a vertical bobbin supporting cylinder 117 formed between the upwardly extended portion and the horizontally extended portion. A bobbin receiving surface 115*a* is formed at a position around the bottom and of the bobbin supporting cylinder 117. The outside end of the upwardly extended portion of each bobbin holder 115 is rigidly held by the upper piece of the corresponding chain piece assembly 114*a* and a slider 116 is rigidly held by the horizontally extended portion in such a way that the slider 116 is capable of sliding on the conveyor cover 47.

When the chain cover 114 is stopped for commencing the normal twisting and winding operation, each bobbin holder 115 is stopped at a corresponding position where the vertical axis of the bobbin supporting cylinder 117 coincides with the axial center of a corresponding bobbin driving shaft 52. In such a condition, the bobbin driving shaft 52 is capable of being inserted into the bobbin supporting cylinder 117.

When all bobbin driving shafts 52 are displaced downward from the positions for supporting the respective bobbin 57, for carrying out the doffing operation of the full yarn packages 62, as shown in FIG. 4, each bobbin 57 is separated from the cylindrical portion 52*a* of the bobbin driving shaft 52 so that each bobbin 57 may stably be held only by the above-mentioned supporting cylinder 117 of the corresponding bobbin holder 115. As shown in FIG. 3, since the bottom end of the bobbin 57 is held at a position slightly above the bobbin receiving surface 115*a* of the bobbin holder 115 when the bobbin driving shaft 52 is displaced to a raised position for driving the bobbin 57, the bobbin holder 115 does not interfere with the smooth rotation of the bobbin 57.

As mentioned above, when the conveyor chain 114 is driven by the driving sprocket 112 in a direction designated by arrows in FIGS. 5A and 5B, the full yarn packages 62 are carried along a longitudinal direction of the lower frame body 44 in a space between the flyers 40 and the conveyer cover 47 in such a condition that the carrying passage of the full yarn packages 62 coincides with a line formed by connecting the axial centers of the flyers 40.

DRIVING MECHANISM OF THE CONVEYING MEANS

The driving mechanism of the conveying means is the first embodiment, that is, the chain conveyer 114 is hereinafter explained in detail.

Figure 7:
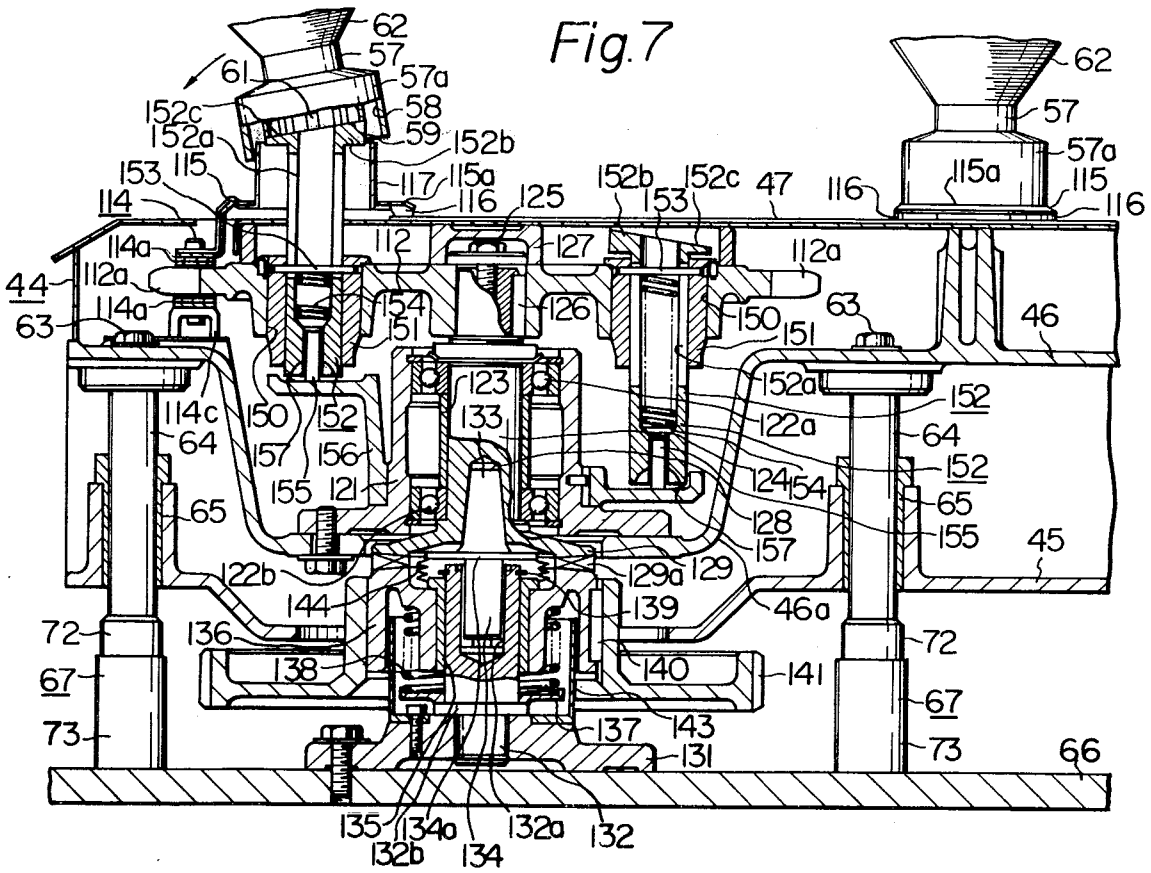
FIG. 7 is a sectional front view of a mechanism for driving the conveyor mechanism shown in FIGS. 5A and 5B and an automatic mechanism for discharging the full packaged bobbins from the conveyer mechanism.
Figure 8:
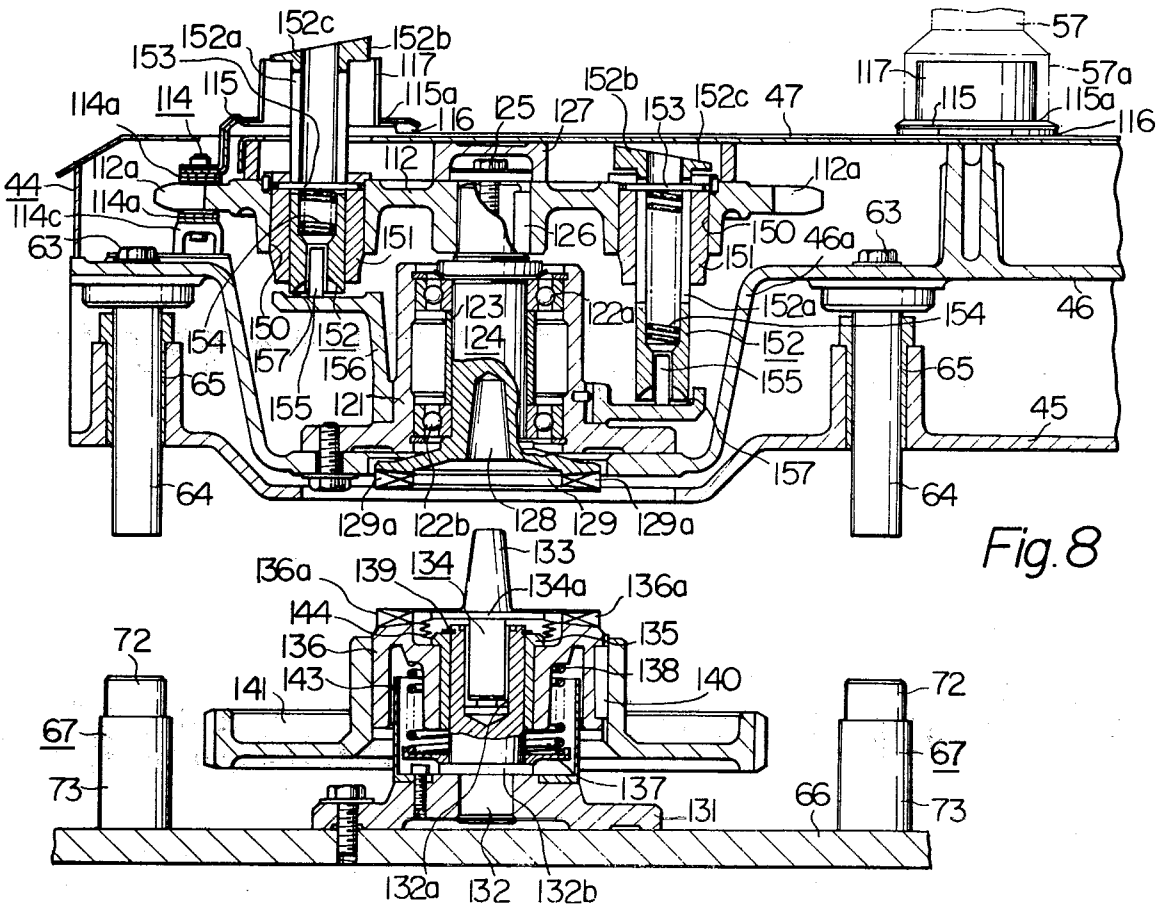
FIG. 8 is a sectional front view of the driving mechanism and the bobbin discharging mechanism shown in FIG. 7, which will be used for explaining the operational function thereof.

Referring to FIGS. 7 and 8, the driving mechanism of the chain conveyor 114 comprises a driven part disposed on a lower frame body 44, and a drive part disposed on a bottom frame body 66 in such a condition that when the lower frame body 44 is positioned at the lowermost position thereof, the driven part is forced to engage with the drive part for driving the conveying means. The conveyor rail 46 of the lower frame body 44 is provided with an upwardly opened recess portion 46*a* formed at a right end portion thereof, and a supporting cylinder 121 having a substantially cylindrical shape is secured to the recess portion 46*a* in upright condition. A driven shaft 124 is rotatably disposed in the supporting cylinder 121 via a pair of bearings 122*a*, 122*b* and a sleeve 123. The sprocket wheel 112 is rigidly mounted on a top end portion of the driven shaft 124 by a bolt 125 and a key 126, and a cap 127 covers the bolt 125. An engaging aperture 128 is formed at a bottom end portion of the driven shaft 124, along the vertical axis thereof, in such a shape that the lateral cross-sectional diameter thereof is gradually increased toward the opening thereof. The recess portion 46*a* is provided with a central aperture where the bottom portion of the driven shaft 124 passes through. A clutch ring 129 is secured to the bottom of the driven shaft 124 as shown in FIG. 8 and the clutch ring 129 is provided with a plurality of pawls 129*a* formed at a lower peripheral edge thereof. Therefore, the pawls 129*a* are projected downward from the aperture of the recess portion 46*a*.

A supporting bracket 131 is secured to the bottom frame body 66 at a right end portion thereof and a supporting shaft 132 is rigidly mounted on the supporting bracket 131 at a position where the axis of the driven shaft 124 is arranged on an upwardly extended line of the central axis of the supporting shaft 132. The supporting shaft 132 is provided with a supporting aperture 132*a* formed at the upper end portion thereof in coaxial condition and a connecting shaft 132 is rigidly engaged in the supporting aperture 132*a*. The connecting shaft 134 is provided with an upwardly tapered projection 133 which is capable of engaging into the engaging aperture 128 of the driven shaft 124. Therefore, when the lower frame body 44 is displaced downward to a particular position where the guide bars 64 projected downwardly from the conveyor rail 46 contact the corresponding stoppers 67 projected upwardly from the bottom frame body 66, the upwardly tapered portion 133 of the connecting shaft 134 is inserted into the engaging aperture 128 of the driven shaft 124.

The clutch body 136 is mounted on the supporting shaft 132 via a sleeve 135 in such a condition that the clutch body 136 is capable of rotating about the supporting shaft 132 and also capable of sliding along the axial direction of the shaft 132. The clutch body is provided with a plurality of pawls 136*a* which are capable of engaging with the pawls 129*a* of the clutch ring 129. A coil spring 138 is mounted in a cylindrical space formed in the clutch body 136 and the compression of the coil spring 138 is defined by a washer 137 secured on a flange 132*b* of the supporting shaft 132 and the upper bottom of the above-mentioned cylindrical space. Therefore, the clutch body 136 is always urged upward by the action of the coil spring 138, but the upper most position of the clutch body 136 is restricted by a stopper 139 secured to a top end position of the supporting shaft 132. Accordingly, when the lower frame body 44 is displaced downward for carrying out the doffing operation, if the clutch ring 129 contacts the clutch body 136 without engaging the pawls 129*a* with the pawls 136*a*, the clutch body 136 is displaced downward against the action of the coil spring 138, and the pawls 129*a* are engaged with the pawls 136*a* smoothly so that the engagement of the clutch ring 129 with the clutch body 136 is accomplished.

A driving wheel 141 is mounted on the clutch body 136 in an axially slidable condition via a slide key 140, and the driving wheel 141 is dirven by a driving source such as a motor (not shown) in an engaging condition of the clutch ring 129 and the clutch body 136 by way of a power transmission mechanism (not shown). When the driving wheel 141 is driven, the driving power is transmitted to the driving sprocket wheel 112 via the slide key 140, the clutch body 136 and the clutch ring 129. Consequently, the chain conveyor 114 is driven toward a direction represented by an arrow in FIGS. 5*a* and 5*b*.

The coil spring 138 is protectd by a cylindrical body 143 rigidly mounted on the supporting bracket 131, and the upper portion of the supporting shaft 132 is protectd by a bellows 144 mounted on a flange 134*a* of the connecting shaft 134 and an upper peripheral edge of the sleeve 135.

As mentioned above, when the lower frame body 44 is displaced downward so as to carry out the doffing operation, the tapered projection 133 of the connecting shaft 134 is engaged into the tapered aperture 128 of the driven shaft 124. Consequently, the pawls 129*a* of the clutch ring 129 engage with the pawls 136*a* of the clutch body 136 so that the driving wheel 141 is driven. Therefore, the sprocket wheel 112 is rotated so as to displace the chain conveyor 114 toward the directions *a* and *b* in FIGS. 5A and 5B. As a result, a plurality of bobbins 57, whereon full yarn packages 62 are formed, mounted on the respective bobbin holders 115 are displaced along a longitudinal direction of the lower frame body 44 from the respective axial positions, which coincide with the axial positions of the corresponding driving shafts 52. In the above-mentioned displacement of the full packaged bobbins 57, the carrying passage of these full yarn packages 62 is formed on a line which passes the rotational center of flyers 40 in the space between the flyers 40 and the conveyor cover of the lower frame body 44.

The full yarn packages 62 are discharged from the respective bobbin holders 115 of the chain conveyor 114 by a bobbin discharge mechanism, which will be explained in detail later, at a left end turning portion of the chain conveyor 114.

After discharging the full yarn packages 62 from the chain conveyor 114, the lower frame body 44 is displaced upward to a position for carrying out the normal twisting and winding operation of the fly frame. In this upward displacement motion of the lower frame body 44, the clutch ring 129 is separated from the clutch body 136 and the driven portion of the mechanism for driving the chain conveyor 114 is displaced upward together with the lower frame body 44 to a position shown in FIG. 1. As mentioned above the load applied to the lower frame body 44 can be reduced remarkably by applying the above-mentioned separatable driving mechanism.

BOBBIN DISCHARGE MECHANISM

The mechanism for discharging bobbins 57 of full yarn packages 62 from the bobbin holder 115 of the chain conveyer 114 is hereinafter explained in detail.

Figure 6:
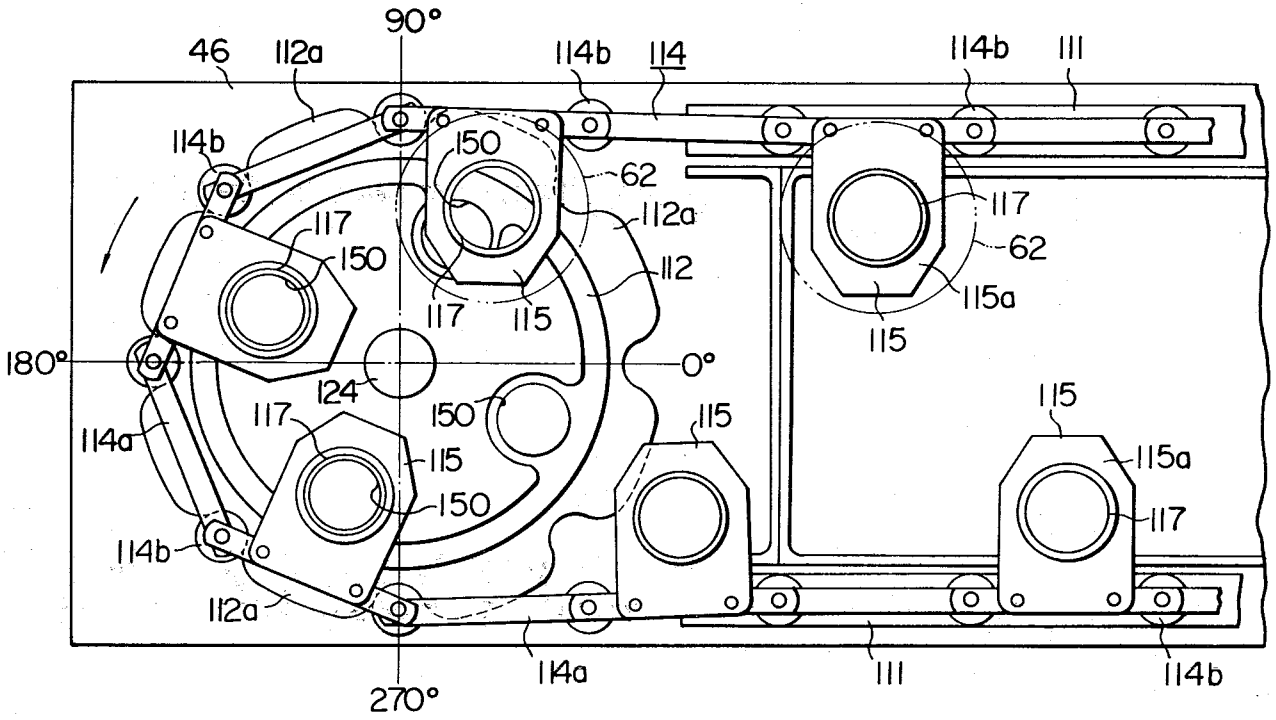
FIG. 6 is a more detailed plan view of a part of the conveying mechanism shown in FIG. 5B.
Figure 9:
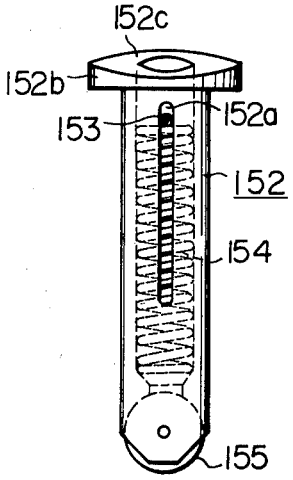
FIG. 9 is a schematic side view of an element of the bobbin discharging mechanism shown in FIGS. 7 and 8.
Figure 10:
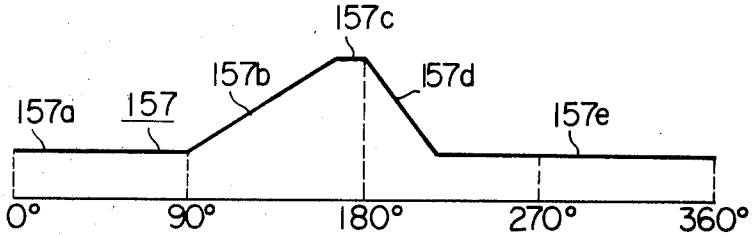
FIG. 10 is a cam profile of a cam utilized for the bobbin discharging mechanism shown in FIGS. 7 and 8.

Referring to FIGS. 6, 7, 8, 9 and 10 the sprocket 112 is provided with a plurality of vertical apertures 150 (in this embodiment, four apertures). These apertures 150 are symmetrically arranged with respect to the driven shaft 124 in such conditions that, the axial center of each aperture 150 coincides with the axial center of the bobbin supporting cylinder 117 of each bobbin holder 115 when the bobbin holder 115 is displaced together with the sprocket 112 along a semi circular carrying passage above the sprocket 112. This semi circular carrying passage is defined by a radial angle between 90° and 270° with respect to the axial center of the driven shaft 124 as shown in FIG. 6. A projection piece 152 is slidably engaged in each aperture 150 via a sleeve 151 rigidly inserted therein. Each projection piece 152 is a cylindrical body and is provided with a pair of upright slits 152*a* symmetrically formed in the cylindrical body. A pin 153 mounted on an upper end portion of the sleeve 151 passes through the upright slits 152*a* and, consequently, the upward or downward sliding motion of each projection piece 152 is guided by the pin 153. As shown in FIG. 7, there is provided a coil spring 154 in a space between an inside bottom surface of each projection piece 152 and the corresponding pin 153 and, as a result, each projection piece 152 is always urged downwardly by the action of the coil spring 154. A roll 155 is turnably mounted on a bottom end portion of each projection piece 152. A cam member 156 is secured on the bottom portion of the supporting cylinder 121 and the roll 155 of each projection piece 152 is capable of rolling on a cam surface 157 formed on the cam member 156, as shwon in FIGS. 7 and 8. As shown in FIG. 10, the cam surface 157 is composed of a first lower horizontal surface 157*a*, an ascending slope surface 157*b*, a higher horizontal surface 157*c*, a descending slope surface 157*d* and a second lower horizontal surface 157*c*. These cam surfaces are formed successively on the peripheral portion of the cam member 156. When the sprocket 112 is driven, the roll 155 of each projection piece 152 rolls on the above-mentioned cam surfaces so that the projection piece 152 is forced to project beyond the sprocket 122 or positioned at a position below the upper surface of the sprocket 112.

The projection piece 152 is provided with a laterally expanded portion 152*b* which is capable of passing through the supporting cylinder 117 of the bobbin holder 115 during the above-mentioned semi circular passage above the sprocket 112. Consequently, the bobbin 57 of the full yarn package 62 is pushed upward from the supporting cylinder 117 by the laterally expanded portion 152*b* of the projection piece 152 when the roll 155 of the projection piece 152 comes to the higher horizontal cam surface 157*c* of the cam member 156. As a result, the full yarn package 62 is discharged from the bobbin holder 115, as shown in FIG. 7.

In order to discharge the full yarn package 62 from the bobbin holder 115 toward a predetermined direction, an inclined surface 152*c* is formed at the top end of the expanded portion 152*b* of the projection piece 152 so as to drop the full yarn package 62 outside the sprocket 112 as shown in FIGS. 7, 8 and 9. Therefore, when the bobbin holder 115 is carried to the terminal of the above-mentioned semi-circular carrying passage above the sprocket, which corresponds to the upper horizontal cam surface 157*c*, the bobbin 57 of the full yarn package 62 is pushed upward from the supporting cylinder 117 by the inclined surface 152*c* of the projection piece 152, so that the bobbin 57 falls toward the outside direction of the sprocket 112 as indicated by an arrow in FIG. 7.

All full yarn packages 62 are carried to the semi-circular carrying passage above the sprocket 112 by the respective bobbin holders 115 of the chain conveyor 114 and discharged from the supporting cylinder 117 of the corresponding bobbin holder 115 at the position above the higher horizontal cam surface 157*c* toward a predetermined position outside the sprocket 112. Consequently, if a container 158 is positioned at a receiving position corresponding to the above-mentioned predetermined position, as indicated by a two dot dash line in FIG. 5A, all full yarn packages 62 can be automatically received in the container 158. Instead of utilizing such a container 158, if an automatic conveyer is extended from the above-mentioned predetermined position to the ring spinning room, the labor cost for carrying the full yarn packages 62 can be also reduced.

In the above-mentioned embodiment of the doffing apparatus according to the present invention, a fresh bobbin supply device is satisfactorily utilized. That is, the fresh bobbin supply device is disposed along the carrying passage of the bobbin holder 115 at the downstream position from the sprocket 112 as indicated by a reference numeral 160 in FIG. 5A.

FRESH BOBBIN SUPPLY DEVICE

Since a fresh bobbin supply device is utilized for the above-mentined doffing apparatus, the principal mechanism and function thereof is hereinafter explained.

Referring to FIGS. 11, 12, 13, 14 and 15, a fresh bobbin supply chute 160 is disposed above the lower frame body 44 at a downstream position from the sprocket 112 along the carrying passage of the bobbin holders 115. The fresh bobbin supply chute 160 is provided with an inlet aperture 160*a* for receiving fresh bobbins 57 therethrough at a top front portion thereof and with an outlet aperture 160*b* for discharging the fresh bobbin 57 therefrom at a rear end portion thereof. The bottom wall 161 of the chute 160 forms a descending slope toward the downstream direction of the carrying passage of the bobbin holders 115.

A pair of supporting edges 161*a* are formed at a rear end portion of the bottom wall 161 in order to support a laterally enlarged portion 57*a* formed at the bottom end of each bobbin 57. A cut-out recess 161*b* is formed between the supporting edges 161*a* so as to accept the bobbin supporting cylinder 117 of each bobbin holder 115. A pair of supporting legs 161*c* are projected downward from the bottom of the chute 160.

A pair of upright front walls 162 are projected upward from an upper end of the bottom wall 161. Each front wall 162 is provided with a cut-out portion 162*a*. The intervening space 162*b* between the front walls 162 is changed in such a way that the intervened space 162*b* at the top portion thereof is smaller than the lateral size of the bottom enlarged portion 57*a* of the bobbin 57 but is larger than the lateral diameter of the top portion of the bobbin 57, and the intervening space between the front walls 162 is gradually enlarged toward the bottom portion thereof. The intervening space between the front walls 162 at the position below the cut-out portions 162*a* is larger than the diameter of the bottom enlarged portion 57*a* of the bobbin 57 so that the bottom portion 57*a* of the bobbin 57 can be passed therethrough freely. This portion is designated as 162*c*.

A pair of side frames 163 formed at both rear end sides of the bottom plate 161 are each provided with an upper piece 163*a*, a back piece 163*c* connected to the upper piece 163*a* via a curved portion 163*b*, and a lower piece 163*d* extended from the back piece 163*c* in the forward direction. The front end portions of the upper piece 163*a* and the lower piece 163*d* are secured to an outside top end of the guide groove 162*b* of the front wall 162.

Consequently, the head portion of the bobbins 57 is guided toward the outlet aperture 160*b* via a space between the upper pieces 163*a* and the bottom enlarged portion 57*a* of the bobbin 57 is introduced to the supporting edges 161*a* via the space between the lower pieces 163*d*.

Figure 11:
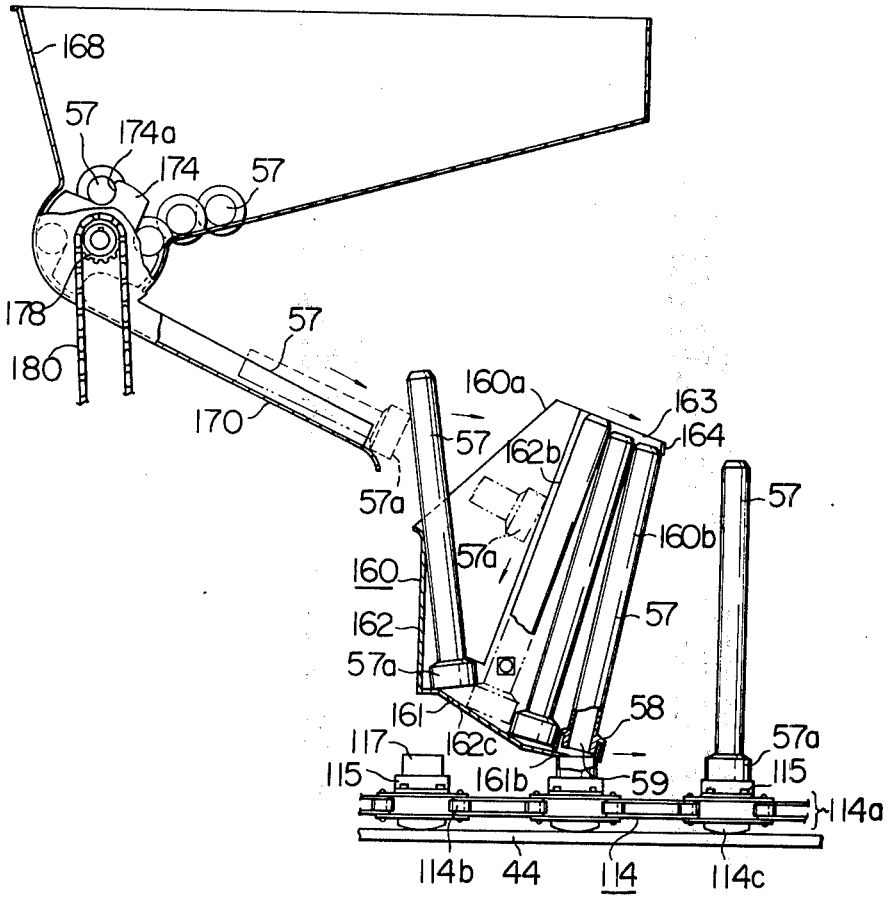
FIG. 11 is a schematic side view, partly in section, of a fresh bobbin supplying device utilized for the doffing apparatus shown in FIG. 1.
Figure 13:
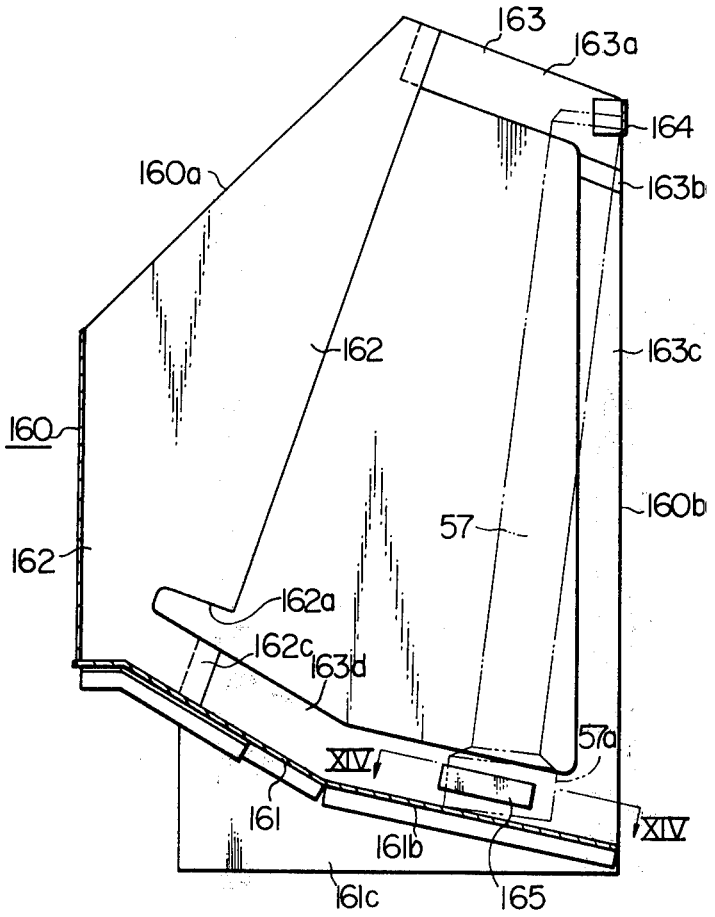
FIG. 13 is a schematic side view of a fresh bobbin supply chute shown in FIG. 11.
Figure 14:
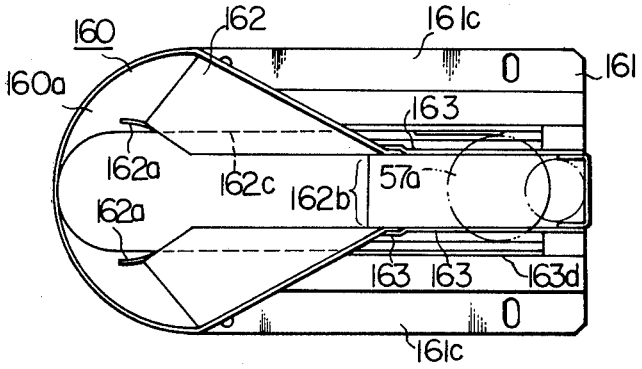
FIG. 14 is a plan view of the fresh bobbin supply chute shown in FIG. 13.
Figure 15:
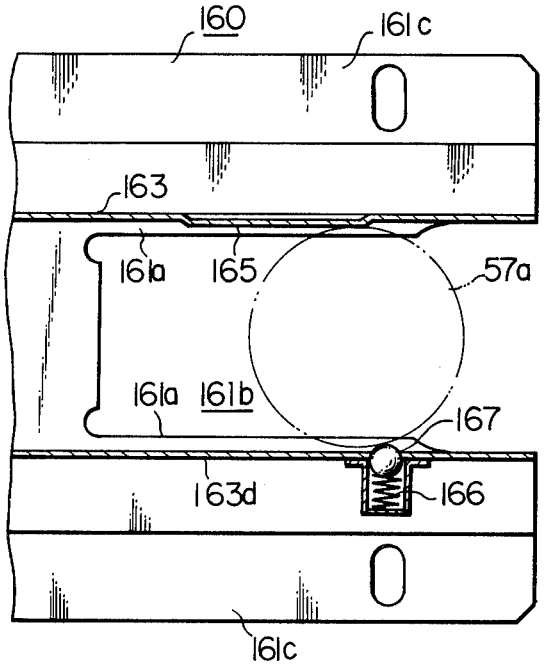
FIG. 15 is a sectional view of the fresh bobbin supply chute, taken along a line XV-XV in FIG. 13.

The bobbin 57 introduced to the outlet aperture 160*b* as mentioned above, is held by a stop means disposed at a position adjacent to the outlet aperture 160*b* in an inclined condition. A stop piece 164 is mounted at a position between the rear end portions of the respective upper pieces 163*a*, and the top end portion of the fresh bobbin 57 introduced into the outlet aperture 160*b* is stopped by the stop piece 164 as shown in FIGS. 11 and 13. A stopper 165 is projected inwardly from the lower piece 163*d* of one of the side frames 163, and a stop ball 167 is disposed in the other lower piece 163*d* in such a condition that a part of the ball 167 is resiliently projected from the inside surface of the side frame 163 by means of a spring 166. Consequently, the bottom portion 57*a* of a fresh bobbin 57 can be resiliently held by the ball 167 at a position between the stopper 165 and the ball 167 itself as shown in FIGS. 14 and 15.

As mentioned above, a fresh bobbin 57, which is supplied into the bobbin chute 160 from the inlet aperture 160*a* in such a condition that a bottom portion of the fresh bobbin is firstly introduced into the chute 160, is led downward through the intervened space 162*b*, and this bobbin 57 is kept in an upright condition at the inlet aperture 160*a*. When the next fresh bobbin 57 is supplied to the chute 160, the above-mentioned advanced fresh bobbin 57 is pushed by this next bobbin 57 so that the advanced fresh bobbin is entirely pushed into the chute 160 and is displaced toward the outlet aperture 160*b*, as shown in FIG. 11. The advanced fresh bobbin 57 is temporarily held by the stop piece 164, the stopper 165 and the stop ball 167 in the upright condition as described before. When the supporting cylinder 117 of a bobbin holder 115 comes into the cut-out portion 161*b* of the bottom wall 161, a part of the supporting cylinder 117 enters into the cylindrical opening of the bottom portion of the fresh bobbin 57. Then, the bobbin 57 is disengaged from the temporary hold by the stop ball 166, the stop piece 164 and the stopper 165 by the movement of the supporting cylinder 117 so that the fresh bobbin 57 is mounted on the supporting cylinder 117 as shown in FIG. 11.

Figure 12:
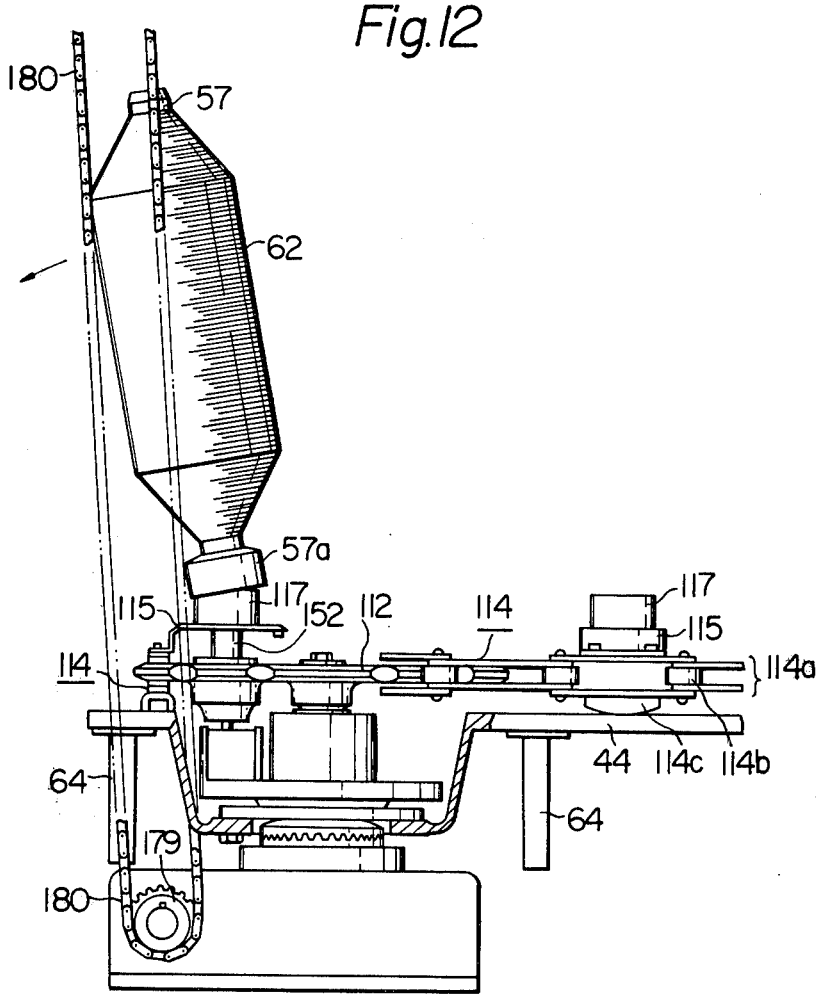
FIG. 12 is a schematic side view of an end portion of the conveyor mechanism shown in FIGS. 5A and 5B in its relation to the fresh bobbin supplying device shown in FIG. 11.

As mentioned above, fresh bobbins 57 are automatically supplied to the bobbin holders 115 of the chain conveyor 114 one by one according to the advancement of the bobbin holders 115. As shown in FIGS. 11 and 12, fresh bobbins 57 are supplied to the bobbin chute 160 from a bobbin supply box 168 disposed above the bobbin chute 160 via a supply conduit 170 disposed therebetween. A bobbin supply drum 174, provided with a plurality of bobbin receiving grooves 174*a* formed horizontally at the peripheral portion thereof, is rotatably disposed at an outer aperture of the bobbin supply box 168. This bobbin supply drum 174 is driven by means of a power transmission mechanism comprising a sprocket wheel 178 secured on a rotational axis of the drum 174, a sprocket wheel 179 rotatably disposed on a frame on the chain conveyor 114 and an endless chain 180 which transmits the driving power from the sprocket wheel 179 to the sprocket wheel 178 as shown in FIGS. 11 and 12. The sprocket wheel 179 is driven by a reduction gear mechanism which receives driving power from the sprocket 112. As it is necessary to supply a suitable number of fresh bobbins 57 from the bobbin supply box 168 to the bobbin chute 160, so as to not supply an excess number of fresh bobbins 57 and to prevent a lack of standby fresh bobbins 57 in the chute 160, automatic control devices are applied to the bobbin supply mechanism mentioned above. However, since the bobbin supply box 168 and the bobbin supply chute 160 are not the main subject matter of the present invention, the explanation of these automatic control devices are omitted

DOFFING METHOD OF THE FIRST EMBODIMENT

Referring to FIG. 1 to FIG. 12, when a full yarn package 62 has been formed on each bobbin 57 by the twisting and winding mechanism illustrated either by FIGS. 1 through 4 or in FIGS. 5 through 8, the lower frame body 44 is caused to descend. As a result, each bobbin 57 carrying the full yarn package 62 is separated from the bobbin driving shaft 52 and placed on the corresponding bobbin holder 115 of the chain conveyor 114. These bobbins 57, each carrying the fully yarn package 62, are conveyed by the chain conveyer 114 and successively discharged from the respective bobbin holders 115 on the driving sprocket 112. Downstream of said driving sprocket 112, fresh bobbins 57 are successively charged onto the bobbin holders 115 by the bobbin chute 160. That is, as the chain conveyer 114 moves around, each bobbin holder 115 receives a fresh bobbin 57. When the bobbin holder 115 carrying a fresh bobbin 57 has reached the position directly over the axis of rotation of the corresponding bobbin driving shaft 52, the chain conveyor is stopped and the lower frame body 44 is caused to ascend so as to engage the driving shaft 52 with the corresponding fresh bobbin 57. Thereafter the twisting and winding operation of the fly frame can be started.

DOFFING APPARATUS OF THE SECOND EMBODIMENT

Figure 16:
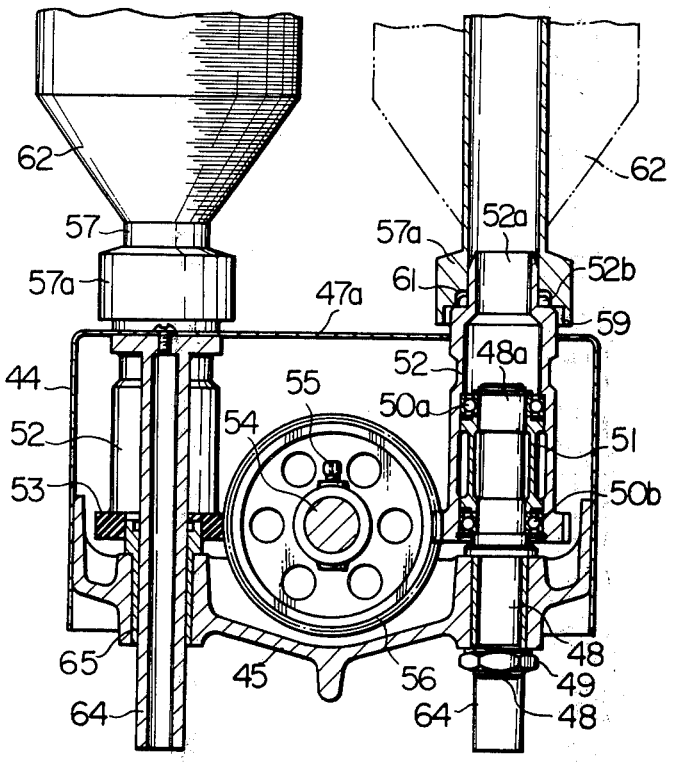
FIG. 16 is a sectional view of a bobbin drive mechanism which is a modification of the mechanism shown in FIG. 3.
Figure 17:
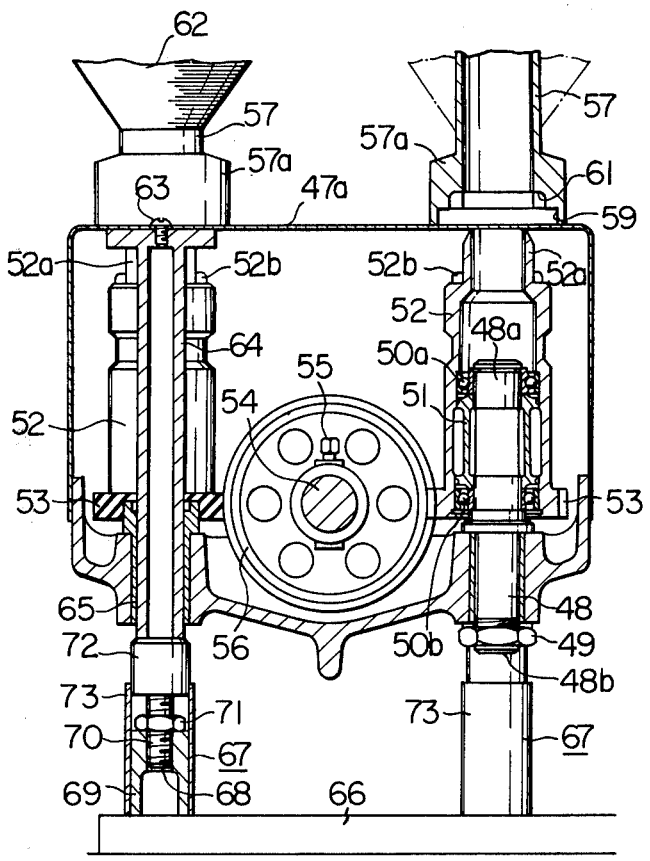
FIG. 17 is also a sectional view of the bobbin drive mechanism shown in FIG. 16, in a disengaged condition from the bobbin.

Referring to FIGS. 16 and 17, the modification of the first embodiment is hereinafter explained in detail. Since many elements identical to the elements of the above-mentioned first embodiment are utilized, these elements are represented by reference numerals identical to those used in the description of the first embodiment and the explanations of these elements are omitted. The main difference of the second embodiment from the first embodiment is the omission of the conveying means for carrying the full yarn packages 62 along the lengthwise direction of the bobbin rail 45. In other words, in this second embodiment, each bobbin is detachably mounted on the corresponding bobbin driving mechanism, and the doffed full yarn package 62 may be transferred manually, for example, can be transferred to a conveyer means (not shown) disposed on a lower frame body or adjacently arranged to the fly frame concerned by means of a mechanical transfer means (not shown). Such mechanical transfer means as a pushing member which transfer the disengaged bobbins of full yarn package from the position where the respective bobbins are disengaged from the corresponding bobbin driving shaft, to the conveyor means can be utilized.

To create the above-mentioned function, the lower frame body 44 is provided with the bobbin rail 45 and a cover member 47*a* which is capable of relatively moving upward to the bobbin rail 45 at the time the bottom portion 57*a* of the bobbin 57 is disengaged from the top portion of the hollow shaft 52 of the bobbin driving mechanism. The bobbin 57 is used for this embodiment is provided with a laterally expanded bottom portion 57*a* which has cut-out recesses 61 that permit insertion of the top portion of the hollow shaft 52. The top portion 52*a* of the hollow shaft 52 is provided with an annular step where a pair of engaging pieces 52*b* are symmetrically projected upward as shown in FIGS. 16 and 17. The cut-out recess 61 is provided with a plurality of cut-out portions, each of them being capable of engaging with the engaging pieces 52*b* formed on the stepped portion of the hollow shaft 52 when the top portion of the hollow shaft 52 is inserted into the cut-out space 61. Therefore, the engagemet or disengagement of the bottom portion of the hollow shaft 52 and the bobbin 57 can be carried out by a relative vertical motion between the bobbin 57 and the hollow shaft 52.

The above-mentioned relative vertical motion between the bobbin 57 and the hollow shaft 52 is created by the following mechanism. That is, the cylindrical guide bars 64 are directly connected to the cover member 47*a* by a fastening bolt 63 instead of connecting the conveyor rail 46 in the first embodiment. Consequently, when it is required to disengage the hollow shafts 52 of the driving mechanism from the respective bobbins 57, the bobbin rail 45 is firstly displaced downward together with the cover 47*a* and, when the bottom end of the guide bar 64 contacts the corresponding stopper piece 72, the cover 47*a* is stopped while the bobbin rail 45 is displaced to it lower most-position. Therefore, the cover 47*a* is separated from the bobbin rail 45 as shown in FIG. 17, where the bottom portion 57*a* of the bobbin 57 is separated from the hollow shaft 52 of the driving mechanism. Consequently, the doffing operation of the full yarn package 62 can be easily carried out manually. Further, when it is required to mount a fresh bobbin 57 onto the corresponding drivng mechansim, the cover member 47*a* is firstly moved to its normal position shown in FIG. 16 and, thereafter, the fresh bobbin 57 is mounted on the top portion 52*a* of the corresponding hollow shaft 52.

Another form of the twisting and winding mechanism usable in the invention will now be described with reference to FIGS. 18 through 21. Since many elements identical to the first embodiment are used in this third embodiment, these elements are represented by reference numerals identical to those used in the description of the first embodiment shown in FIGS. 1, 2, 3 and 4, and the explanation thereof is omitted. This twisting and winding mechanism is different from the first embodiment with respect to the construction of the lower frame body as well as the driving mechanisms for the rotation and vertical motion of the bobbins 57.

Figure 20:
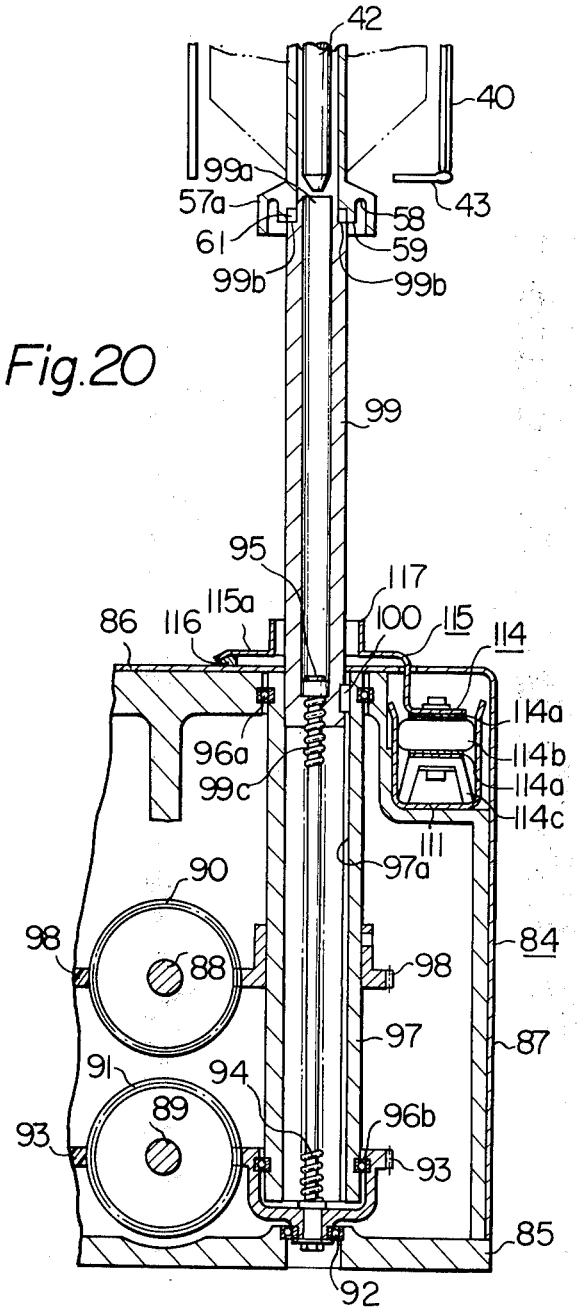
FIG. 20 is a sectional side view of the bobbin drive mechanism shown in FIG. 18.
Figure 21:
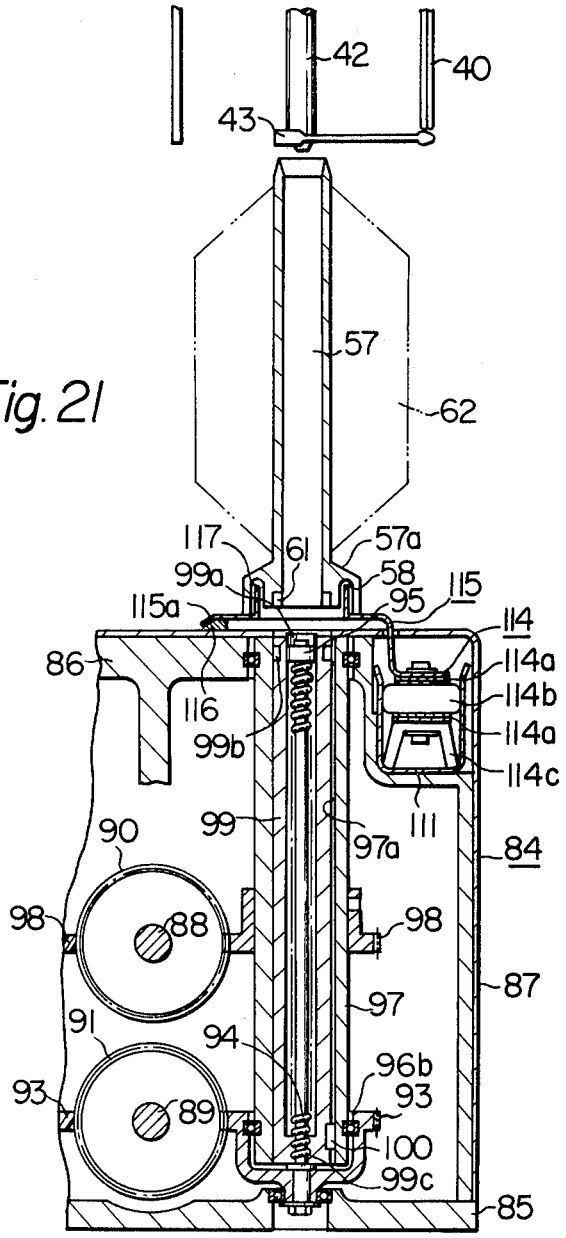
FIG. 21 is a sectional side view of the bobbin drive mechanism shown in FIG. 18 in the condition of the first step of the doffing operation.

As seen from FIGS. 20 and 21, the illustrated lower frame body 84 comprises a bottom frame 85, a supporting frame 86 rigidly mounted on the bottom frame 85 and a cover 87 rigidly mounted on the supporting frame 86. The frame body 84 is fixed on the floor and is not capable of vertical motion. In the supporting frame 86, a longitudinally extending upper horizontal driving shaft 88 and a longitudinally extending lower horizontal driving shaft 89 are arranged in parallel. The upper driving shaft 88 is rotated by means of a suitable power source, such as an electrical motor (not shown), and carries a plurality of driving gears 90 thereon for driving indivisual rotatable cylinders 97. The lower driving shaft 89 is adjustably rotated by using a suitable variable speed driving mechanism (not shown), and carries a plurality of driving gears 91 thereon for driving indivisual threaded rods 94.

A plurality of driven gears 93 are arranged in two rows on both sides of the lower driving shaft 89. Each of these driven gears 93 is rotatably mounted on the upper surface of the bottom supporting frame 85 by means of a bearing 92 in such a location that the axis of rotation of the gear 93 coincides with the axis of rotation of the corresponding flyer 40. Each driven gear 93 is engaged with a corresponding driving gear 91 of the lower driving shaft 89 and a threaded rod 94 is uprightly fixed at the center of each gear 93. The threaded rod 94 upwardly extends to near the top of the cover 87 and is provided with a stopper piece 95 at its upper end. Each threaded rod 94 is concentrically surrounded by the rotatable cylinder 97 rotatably supported by bearings 96*a* and 96*b*. Each cylinder 97 carries a driven gear 98 fixed thereon approximately in the middle of the length of the cylinder 97, which driven gear 98 is engaged with the corresponding driving gear 90 of the upper driving shaft 88. When the upper driving shaft 88 rotates, all the cylinders 97 are caused to rotate concurrently.

A substantially cylindrical bolster 99 is vertically and slidably inserted into an annular space formed between the threaded rod 94 and the inner surface of the rotatable cylinder 97. The bolster 99 has a slide key 100 on its side near the bottom end. The slide key 100 slidably engages with a key groove 97a vertically formed in the inner wall of the rotatable cylinder 97, ensuring not only the vertical sliding motion of the bolster 99 in the cylinder 97 but, also, the transmission of the rotation of the cylinder 97 to the bolster 99. The bolster 99 further has a threaded portion 99*c* at the lower end thereof, which portion may engage with the threaded rod 94. Thus, the bolster 99, which is caused to rotate integrally with the cylinder 97 by means of the upper driving shaft 88 via the corresponding driving gear 90 and driven gear 98, is caused to vertically move, depending on the difference in the rate of rotation between the bolster 99 (or the cylinder 97) and the threaded rod 94 which is caused to rotate by means of the lower driving shaft 89 via the corresponding driving gear 91 and driven gear 93.

The bolster 99 may, as shown in FIG. 20, extend from the inside of the rotatable cylinder 97 upwardly through an aperture formed in the cover 87 of the lower frame body 84, and is provided, at the upper end of the bolster 99, with an engagably supporting cylindrical portion 99*a*, which has a diameter smaller than the body of the bolster 99 and also has a tapered upper end and with a pair of engaging pieces 99*b*. The engagably supporting cylindrical portion 99*a* is capable of engaging with the bottom portion of the corresponding bobbin 57, while the pair of engaging pieces 99*b* is capable of engaging with any one of the pairs of engaging grooves 61 formed at the bottom portion of the bobbin 57. Thus, the bolster 99 engages with and supports the corresponding bobbin 57 in the same manner as the bobbin driving shaft 52 does in the first embodiment.

Figure 18:
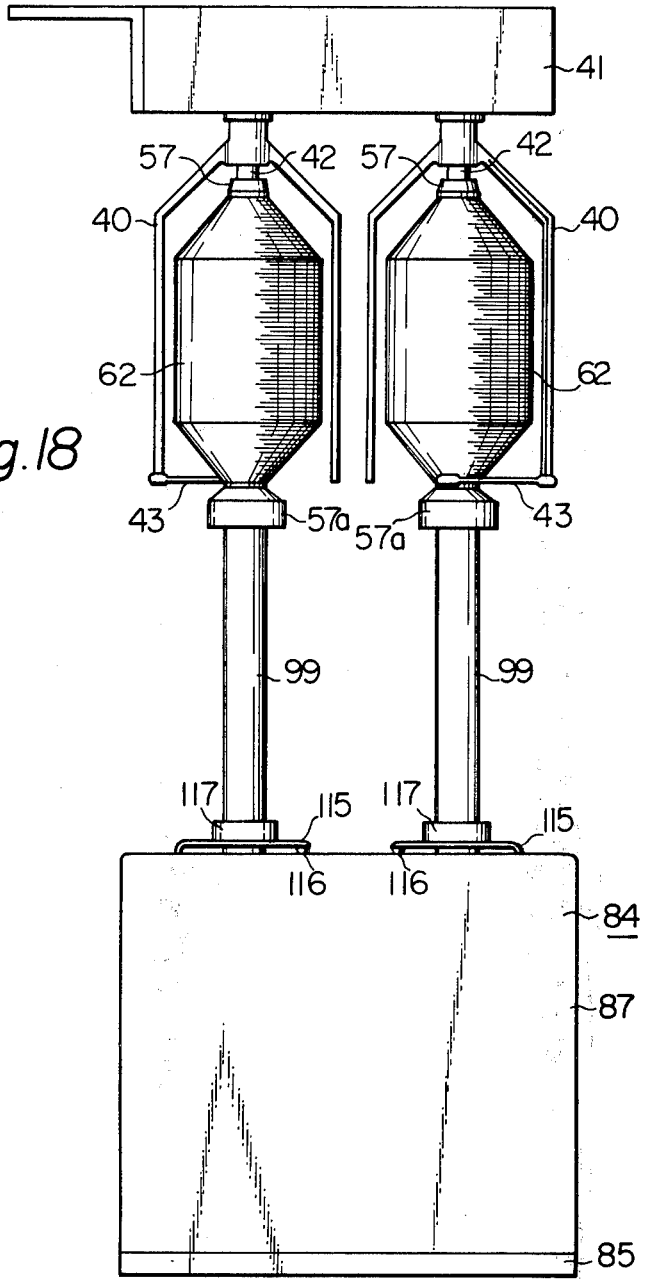
FIG. 18 is a schematic side view of a twisting and winding unit of the fly frame, provided with a modified doffing apparatus according to the present invention.
Figure 19:
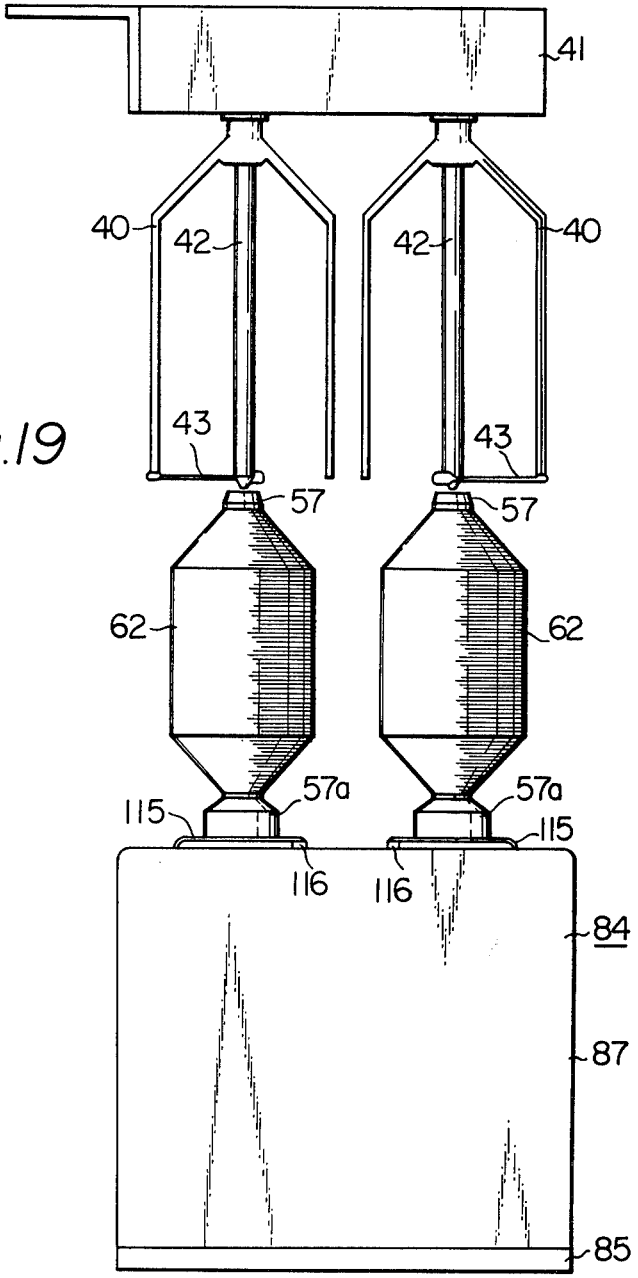
FIG. 19 is a schematic side view of the twisting and winding unit of the fly frame shown in FIG. 18, in the condition of the first step of the doffing operation.

During the twisting and winding operation, each bolster 99 extends, as is shown in FIGS. 18 and 20, from the inside of the corresponding rotatable cylinder 97, upwardly through an aperture formed in the cover 87 at the top thereof, and holds the corresponding bobbin 57 in a raised position for winding by its engagably supporting cylindrical portion 99a. When the flyers 40 and the upper and lower driving shafts 88 and 89 are caused to rotate under these conditions, the rotation of the upper driving shaft 88 is transmitted to each bolster 99 via the corresponding driving gear 90, driven gear 98, rotatable cylinder 97 and slide key 100; while the rotation of the lower driving shaft 89 is transmitted to each threaded rod 94 via the corresponding driving gear 91 and driven gear 93; whereby each bolster 99 is caused to rotate and to vertically move in the corresponding cylinder 97 within a predetermined range of transverse, depending upon the difference in the rate of rotation between the bolster 99 and the corresponding threaded rod 94; the rod 94 engages with the threaded portion 99*c*, and, in consequence, the roving is wound on each bobbin 57.

When a full yarn package 62 has been formed on each bobbin 57, rotation of the flyers 40 and the upper driving shaft 88 is stopped and only the lower driving shaft 89 is allowed to continue to rotate. As a result, each bolster 99 is caused to descend below the range of traverse for winding without rotating and is eventually buried in the lower frame body 84 as shown in FIG. 21. At this moment, each bobbin 57 carrying a full yarn package has been disengaged from the engagably supporting cylindrical portion 99*a* of the corresponding bolster 99 and is located on the supporting frame 86, ready for being subjected to conveying means, such as the chain conveyor 114 utilized for the first embodiment with necessary modifications.

DOFFING MECHANISM APPLIED TO THE CONVENTIONAL TYPE FLY FRAME PROVIDED WITH A SPINDLE RAIL DISPOSED BELOW THE BOBBIN RAIL

The doffing mechanism applied to the apparatus of the first embodiment can be satisfactorily applied to the conventional type fly frame provided with a spindle rail disposed below the bobbin rail, without many modifications of the related mechanism.

The embodiment shown in FIGS. 22, 23, 24 and 25 is a typical example of this type of modification. In this embodiment, the building motion of the fly frame is carried out in a manner similar to the building motion of a conventional fly frame. The difference in this fly frame shown in FIGS. 22, 23, 24 and 25 from the conventional fly frame is based upon the adoption of firstly, a modified bobbin driving mechanism in combination with the flying driving mechanism, and; secondly, an automatic means for conveying full yarn packages along the bobbin rail, which mechanism is quite similar to the chain conveyor 114 of the above-mentioned first embodiment. Consequently, the elements similar to the elements of the first embodiment are represented by identical reference numerals to those used in the first embodiment and the explanation thereof is omitted. The mechanism and function of the modified bobbin driving mechanism in combination with the flyer driving mechanism is hereinafter mainly explained.

Figure 22:
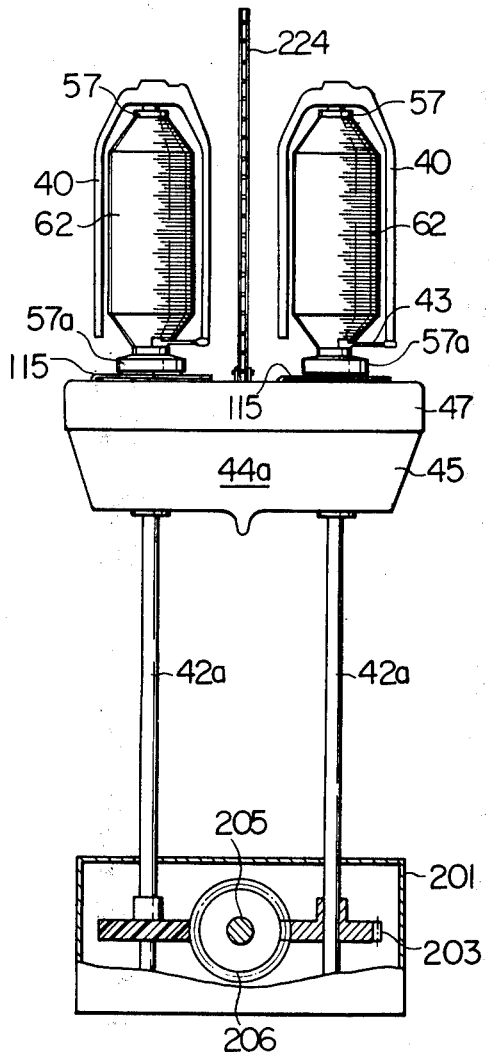
FIG. 22 is a schematic side view of a twisting and winding unit of the fly frame, provided with another modified doffing apparatus according to the present invention.
Figure 23:
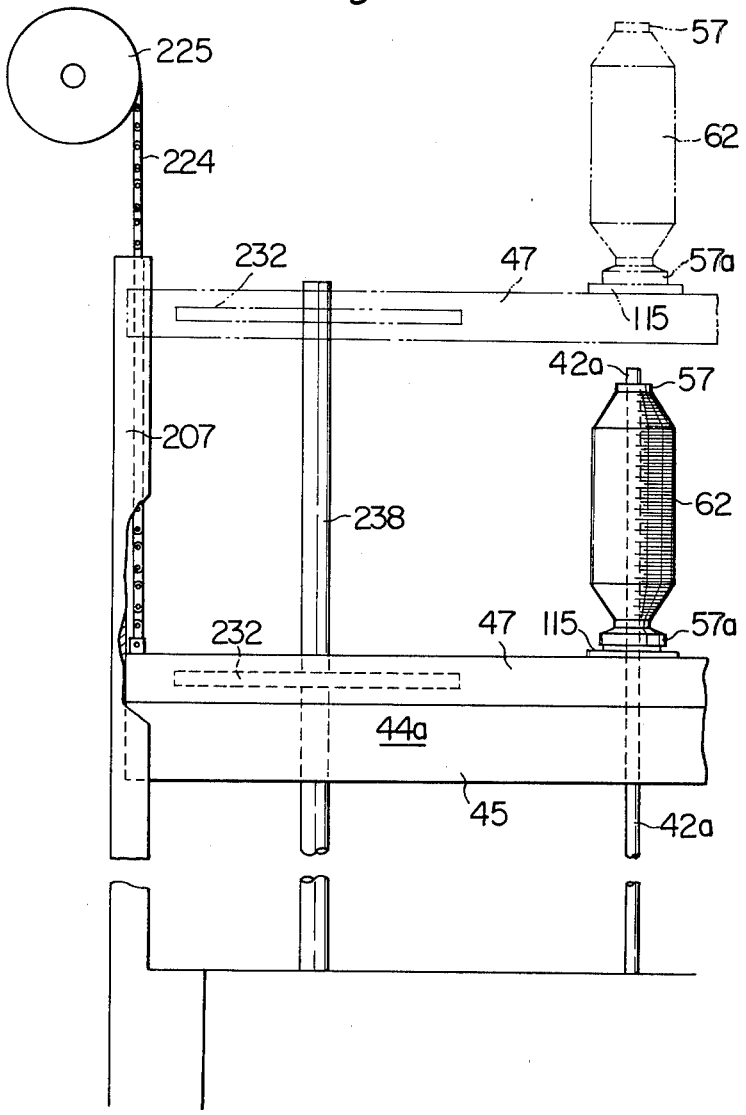
FIG. 23 is a schematic front view of the twisting and winding apparatus according to the present invention.
Figure 24:
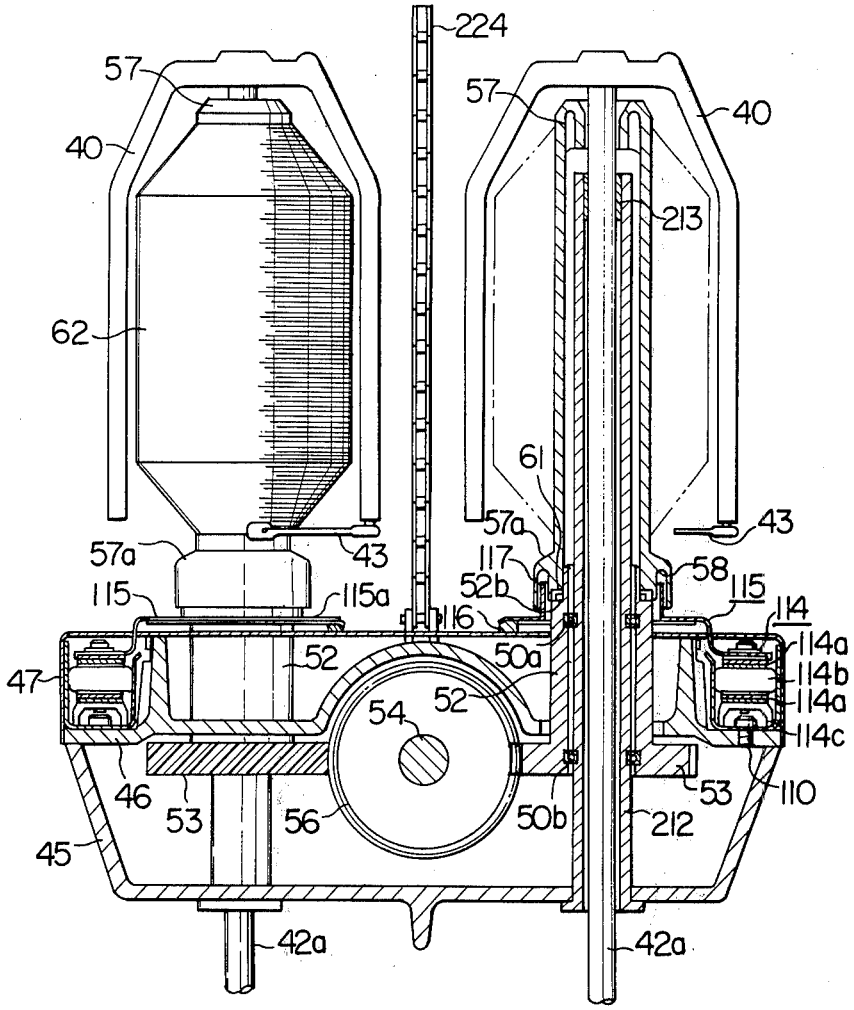
FIG. 24 is a sectional view of the bobbin drive mechanism and a part of the bobbin conveying mechanism mounted on the twisting and winding unit shown in FIG. 22.
Figure 25:
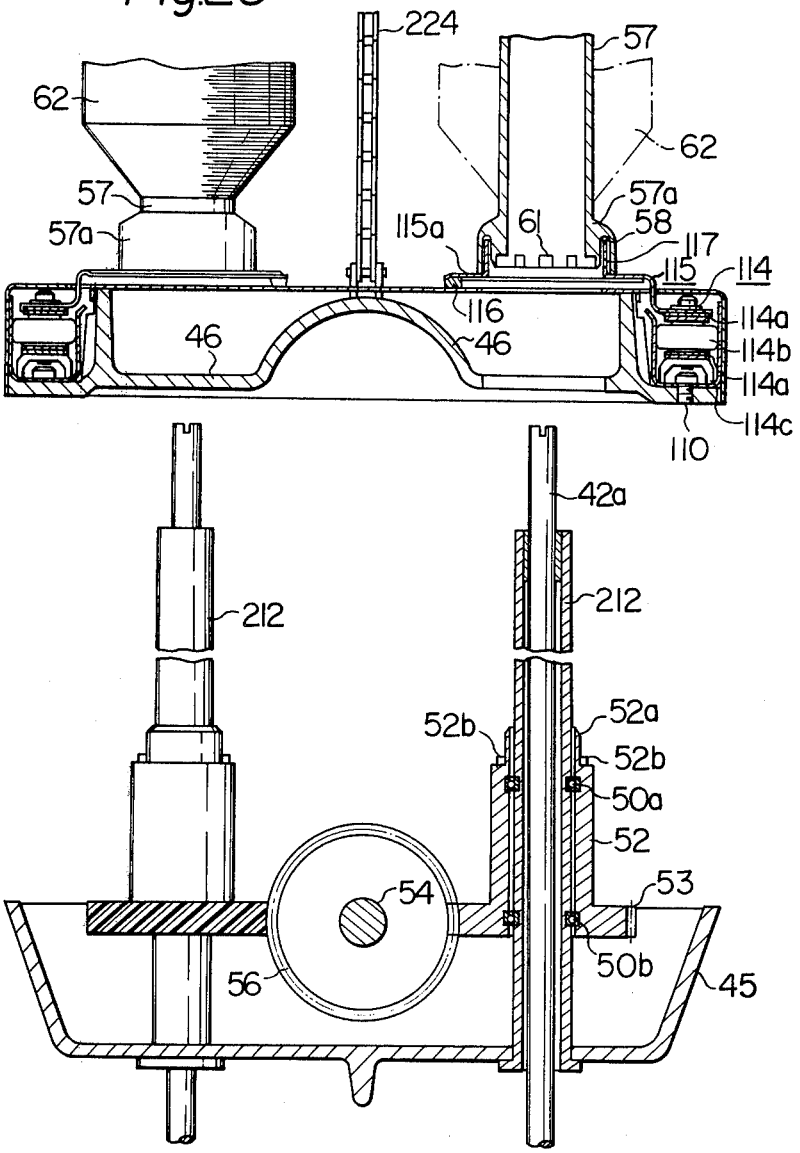
FIG. 25 is a sectional view of the bobbin drive mechanism and a part of the bobbin conveying mechanism shown in FIG. 24, in the condition of the first step of the doffing operation.

As is clearly shown in FIGS. 22 and 23, the fly frame of this embodiment is provided with a stationary spindle rail 201 rigidly mounted on a base floor (not shown) and a horizontal driving shaft 205 is rotatably disposed along the longitudinal direction of the spindle rail 201. A plurality of driving gears 206 are rigidly mounted on the driving shaft 205 with a predetermined spindle pitch (*l*) so as to drive the respective spindles 42*a* turnably mounted on the spindle rail 201 with the above-mentioned spindle pitch at both sides of the driving shaft 205 as shown in FIG. 22 Each spindle 42*a* is driven by a corresponding driving gear 206 via a horizontal gear 203 rigidly mounted on a bottom end portion thereof. A bobbin rail assembly 44*a* is disposed above the spindle rail 201 in such a condition that the bobbin rail assembly 44*a* is capable of displacing up and down, by means of a lifting motion means. As shown in FIGS. 24 and 25, the bobbin rail assembly 44*a* is provided with a bobbin rail 45 horizontally extending along the spindle rail 201 right above the spindle rail 201, a conveyor rail 46 disposed on the lengthwise opening of the bobbin rail 45 and a conveyor cover 47 secured to the conveyer rail 46 so as to cover the upward opening of the conveyer rail 46. A horizontal driving shaft 54 is turnably disposed in the bobbin rail assembly 44a in parallel condition to the shaft 205 and a plurality of driving wheels 56 are rigidly mounted on the shaft 54 with the spindle pitch (*l*). A plurality of vertical hollow bobbin driving shafts 52 are rotatably mounted in the bobbin rail assembly 44a at positions where the vertical axis of the hollow driving shafts 52 coincide with the corresponding vertical axis of the spindle 42*a*, respectively, so that each spindle 42*a* is capable of slidably passing through the corresponding hollow driving shaft 52, via a bolster 212 turnably supported in each hollow driving shaft 52. A pair of ball bearings 50*a* and 50*b* are disposed between the shaft 52 and the bolster 212. A cylindrical bush 213 is mounted in a top hollow portion of the bolster 212 so as to stably support the spindle 42*a* therein. An endless chain conveyer 114, which is similar to the first embodiment, is disposed in a pair of longitudinal spaces formed between the outside edge wall of the conveyer cover 47 and the side ribs 46*a* of the conveyer rail 46. The construction and function of this chain conveyer 114 is identical to the first embodiment and, therefore, a explanation thereof is omitted. Each bobbin driving shaft 52 is provided with a gear portion 53 formed at a bottom portion thereof and each gear portion 53 of the driving shaft 52 is meshed with the corresponding driving gears 56. In this embodiment, the bobbin 57 is provided with a laterally expanded portion 57*a* having a similar construction to the bobbin 57 used for the fly frame of the first embodiment. That is, an annular groove 58 is formed in the bobbin 57 and a plurality of cut-out portions 61 is formed along a peripheral inside wall of the annular groove 58. A bottom edge of the peripheral inside wall is formed inside of the bottom edge of the peripheral outside wall of the annular groove 58, as shown in FIGS. 24 and 25.

Each bobbin supporting cylinder 177 of the bobbin holder 115 can be inserted into the annular groove 58 of the corresponding bobbin as shown in FIG. 24. The construction and function of the chain conveyer 114 is similar to the first embodiment and, therefore, a detailed explanation thereof is omitted. The conveyer rail 47 is suspended by a pair of chains 224 at both longitudinal end portions thereof as shown in FIGS. 23 and 24. The upper end of each chain 224 is connected to a sprocket wheel 225 mounted on a machine frame (now shown) at a position above an uppermost position where the conveyer rail 47 can be displaced upward. A pair of upright guide rails 207 are rigidly mounted on the machine frame (not shown) for guiding both ends of the conveyer rail 47 as shown in FIG. 23. A sprocket wheel 232 for driving the chain conveyer 114 is mounted on a vertical driving shaft 238 in such a condition that the sprocket wheel 232 is capable of sliding along the axial direction of the shaft 238 but is not able to turn about the shaft 238 so that the sprocket wheel 232 is rotatably held at a position on the conveyer rail 46.

During the normal twisting and winding operation, the above-mentioned bobbin rail assembly 44a is displaced up and down in a range of transverse motion by a conventional lifting motion mechanism (not shown), while the shaft 54 is driven by means of a suitable driving mechanism like a conventional one (not shown). In this condition, the top end portion of each bobbin driving shaft 52 engages with the bottom end portion of the corresponding bobbin 57 so that these bobbins are rotated. On the other hand, each spindle 42*a* is driven by the corresponding driving gear 206 in the spindle rail 201. Consequently, rovings from the respective draft mechanisms of the fly frame are twisted and simultaneously would on the respective bobbins 57.

When the full yarn packages 62 are formed on the respective bobbins 57 and it is required to carry out the doffing operation, the flyers 50 are firstly taken from the top end of the respective spindles 42*a*, after stopping the rotation of the spindles 42a and the bobbin driving shafts 52. Next, the sprocket wheel 225 is driven so as to lift the conveyer rail 46 together with the conveyer cover 47 to a position represented by a two dot-dash line in FIG. 23. In this condition, the conveyer rail 46 and the conveyer cover 47 move as one body and they are separated from the bobbin rail 45. This situation is shown in FIG. 25. According to the above-mentioned separation of the bobbin rail assembly 44*a*, each spindle 42*a* is taken from the bobbin 57 of the corresponding yarn package 62. In this condition, the above-mentioned bobbins 57 are supported only by the bobbin cylinder 117 of the respective bobbin holders 115 as shown in FIG. 25. Consequently these full yarn packages can be transported to the outside of the fly frame by the chain conveyer 114 in a space above the bobbin rail 45 and the rows of spindles 42*a*. It will be understood from the above description that the doffing operation can be as effectively carried out as with the first embodiment of the present invention.

What is claimed is:

1. In a method for doffing full yarn packages from a fly frame provided with a plurality of twisting and winding units arranged along the longitudinal direction of said fly frame, a plurality of bobbin driving mechanisms for driving a bobbin mounted on each corresponding twisting and winding unit and means for supporting said bobbin driving mechanisms, a method for doffing full yarn packages from said fly frame comprising, relatively displacing the bobbins containing said full yarn packages and said bobbin driving mechanisms along an axial direction of each bobbin so that said bobbins are disengaged from said bobbin driving mechanisms and are located above said bobbin driving mechanisms, respectively, after completion of forming full yarn packages on said respective bobbins engaged with said bobbin driving mechanisms, respectively, said disengaged bobbins above said driving mechanisms defining a conveying passage in a space above said driving mechanisms along said longitudinal direction of said fly frame, and carrying said disengaged bobbins containing full yarn packages out of said fly frame along said conveying passage formed in said space above the arrangement of said bobbin driving mechanisms, along said longitudinal direction of said fly frame.

2. In a method for doffing full yarn packages from a fly frame provided with a plurality of twisting and winding units arranged along the longitudinal direction of said fly frame, a plurality of bobbin driving mechanisms for driving a bobbin mounted on each corresponding twisting and winding unit and means for supporting said bobbin driving mechanisms, a method for doffing full yarn packages from said fly frame comprising, relatively displacing the bobbins containing said full yarn packages and said bobbin driving mechanisms along an axial direction of each bobbin so that said bobbins are disengaged from said bobbin driving mechanisms after completion of forming full yarn packages on said respective bobbins engaged with said bobbin driving mechanisms, an alignment of axial centers of said bobbins engaged with corresponding bobbin driving mechanisms defining a conveying passage in a space above said driving mechanisms along said longitudinal direction of said fly frame, and carrying said disengaged bobbins containing said full yarn packages along said conveying passage formed in said space above the arrangement of said bobbin driving mechanisms along said longitudinal direction of said fly frame.

3. A doffing method according to claim 1, wherein said conveying passage is formed on said means for supporting said bobbin driving mechanisms, and said bobbin carrying operation along said conveying passage is carried out mechanically.

4. A doffing method according to claim 3, wherein said twisting and winding units are arranged in two rows which are parallel each other, and said conveying passage is a mechanically defined closed passage which passes over positions where said bobbins are capable of engaging with corresponding bobbin driving mechanisms.

5. A doffing method according to claim 4, wherein said carrying operation is carried out by a mechanical conveying means, and said bobbins containing full yarn package are discharged from said mechanical conveying means at a part of said closed conveying passage, further comprising supplying fresh bobbins on said mechanical conveying means at another part of said closed conveying passage.

6. A doffing method according to claim 2, wherein said disengaged bobbins containing full yarn package are discharged from said conveying passage at a side end of said fly frame so that said disengaged bobbins containing full yarn package are discharged from said fly frame.

7. In a fly frame provided with a plurality of twisting and winding units arranged along the longitudinal direction thereof, an apparatus for carrying out doffing operations, comprising in combination with a plurality of bobbin driving mechanisms for driving bobbins, each of which is mounted on a corresponding twisting and winding unit, and means for supporting said bobbin driving mechanisms, means for supporting said bobbins containing a full yarn package in disengaged condition from the corresponding bobbin driving mechanism at the time of carrying out said doffing operation and means for carrying said bobbins supported by said supporting means along a conveying passage formed in a space above the arrangement of said bobbin driving mechanism along said longitudinal direction of said fly frame.

8. An apparatus for carrying out doffing operations according to claim 7, wherein an axial center of each supporting means is capable of coinciding with an axial center of a corresponding bobbin driving mechanism at a time of carrying out the twisting and winding operation.

9. An apparatus for carrying out doffing operations according to claim 7, further comprising means for transferring disengaged bobbins containing a full yarn package from positions where said bobbins are disengaged from the respective bobbin driving mechanisms to said carrying means.

10. An apparatus for carrying out doffing operations according to claim 7, wherein said bobbin driving mechanism and said bobbin supporting means are vertically displaced as one body during the normal twisting and winding operation, said bobbin supporting means being capable of relatively separating from said bobbin driving mechanisms respectively so that said bobbins containing a full yarn package are supported in disengaged condition from a corresponding bobbin driving mechanism at the time of carrying out said doffing operations.

11. An apparatus for carrying out doffing operations according to claim 10, wherein said carrying means is displaced vertically together with said bobbin supporting means.

12. In a fly frame provided with a plurality of twisting and winding units arranged along the longitudinal direction thereof and an upper frame suspending a plurality of flyers and holding means for driving said flyer therein, an apparatus for carrying out doffing operations, comprising in combination with a plurality of bobbin driving mechanisms for driving bobbins mounted on correspondng twisting and winding units, each bobbin driving mechanism being disposed at a postion right below a corresponding flyer, and means for supporting said bobbin driving mechanisms:

means for supporting said bobbins in such a condition that the bobbins are capable of disengaging from the corresponding bobbin driving mechanisms at the time of carrying out said doffing operations, and;

means for carrying said bobbins supported by said supporting means along a conveying passage formed in a space above the arrangement of said bobbin driving mechanisms toward a longitudinal end of said fly frame at the time of said doffing operations.

13. An apparatus for carrying out doffing operations according to claim 12, wherein said means for supporting said bobbin driving mechanism is a bobbin rail disposed along the longitudinal direction of said fly frame, said bobbin rail being provided with a lifting mechanism for vertically displacing of said bobbin rail for making vertical traverse motions during yarn package forming operation and for additionaly displacing to a standby position for carrying out the doffing operations, said bobbin rail and said bobbin supporting means being capable of vertically displacing as one body during said vertical traverse motion and of being separated from each other during the downward displacing motion of said bobbin rail toward said standby position so that the engagement of said bobbins containing a full yarn package with the respective bobbin driving mechanisms can be released.

14. An apparatus for carrying out doffing operations according to claim 13, further comprising means for restricting the downward displacement of said bobbin supporting means, whereby said bobbin supporting means is separated from said bobbin rail during the downward displacing motion of said bobbin rail by said restriction means.

15. An apparatus for carrying out doffing operations according to claim 13, further comprising means for supporting said conveying means disposed between said bobbin rail and said bobbin supporting means, said means for supporting said conveyer means and said bobbin supporting means being capable displacing vertically as one body.

16. An apparatus for carrying out doffing operations according to claim 12, wherein said bobbin driving mechanisms are mounted on a stationary frame, each of said bobbin driving mechanisms is provided with a vertical bolster, each of said bolsters is capable of vertically displacing along an axial direction of a corresponding flyer in a range of traverse motion for forming a yarn package during a twisting and winding operation and is capable of releasably engaging with a bottom end portion of an uprightly disposed bobbin thereon, said bobbin supporting means being capable of disposing at predetermined fixed positions above corresponding bobbin driving mechanisms where said bolsters pass through corresponding bobbin supporting means, whereby when each of said bolsters is vertically displaced to a lowermost position thereof, a top end of said bolster is left downward from a corresponding bobbin supporting means so that said engagement of said bobbin with said bolster is released.

17. An apparatus for carrying out doffing operations according to claim 12, wherein said carrying means is a conveyer extended longitudinally along said fly frame, said bobbin supporting means are a plurality of bobbin holders rigidly mounted on said conveyer with an intervened distance between two adjacent bobbin supporting means which coincides with an axial pitch of two adjacent flyers along the longitudinal direction of said fly frame.

18. An apparatus for carrying out doffing operations according to claim 17, wherein said conveyer is an endless chain conveyer whereon said bobbin holders are rigidly mounted, said endless chain conveyer being provided with a carrying passage which coincides with an alignment or alignments of the axial rotational centers of said flyers.

19. An apparatus for carrying out doffing operations according to claim 18, wherein each bobbin holder is provided with a bobbin supporting cylinder which is capable of engaging into a bottom end aperture of said bobbin, an axial center of each of said bobbin supporting cylinders being capable of passing along said carrying passage.

* * * * *

UNITED STATES PATENT OFFICE

CERTIFICATE OF CORRECTION

Patent No. 4,023,338 Dated May 17, 1977

Inventor(s) Takuzo Tooka, et al

It is certified that error appears in the above-identified patent and that said Letters Patent are hereby corrected as shown below:

Column 6, line 16: After "rail" insert --41, whereupon a roving, which is guided from each flyer--.

Column 8, line 4: "cover" should be --conveyer--.

Column 9, line 12: "132" should be --134--.

line 40: "position" should be --portion--.

line 52: "dirven" should be --driven--.

Column 11, line 8: "shwon" should be --shown--.

Column 14, line 1: Change "by" to --in--.

line 56: Delete "is".

Column 19, line 9: "50" should be --40--.

Signed and Sealed this

Sixth Day of December 1977

[SEAL]

Attest:

RUTH C. MASON
Attesting Officer

LUTRELLE F. PARKER
Acting Commissioner of Patents and Trademarks